US005445517A

United States Patent [19]

Kondou et al.

[11] Patent Number: 5,445,517

[45] Date of Patent: Aug. 29, 1995

[54] ADAPTIVE NOISE SILENCING SYSTEM OF COMBUSTION APPARATUS

[75] Inventors: Masamitsu Kondou, Katano; Yasuhiro Umekage, Osaka; Kunio Nakamura, Ikoma, all of Japan

[73] Assignee: Matsushita Electric Industrial Co., Ltd., Kadoma, Japan

[21] Appl. No.: 135,494

[22] Filed: Oct. 13, 1993

[30] Foreign Application Priority Data

| | | | |
|---|---|---|---|
| Oct. 14, 1992 | [JP] | Japan | 4-275649 |
| Oct. 14, 1992 | [JP] | Japan | 4-275653 |
| Feb. 3, 1993 | [JP] | Japan | 5-016070 |
| Feb. 4, 1993 | [JP] | Japan | 5-017180 |

[51] Int. Cl.[6] ..... F23N 1/00; F23C 11/04

[52] U.S. Cl. ..... 431/18; 431/1; 431/114; 181/206; 381/11; 381/71

[58] Field of Search ..... 431/114, 18, 1; 181/206; 381/11, 71

[56] References Cited

U.S. PATENT DOCUMENTS

| | | | |
|---|---|---|---|
| 4,153,815 | 5/1979 | Chaplin et al. | 381/71 |
| 4,583,936 | 4/1986 | Krieger | 431/1 |
| 5,060,271 | 10/1991 | Geddes | 381/71 |
| 5,145,355 | 8/1992 | Poinsot et al. | 431/1 |
| 5,229,556 | 7/1993 | Geddes | 181/206 |
| 5,325,438 | 6/1994 | Browning et al. | 381/11 |

FOREIGN PATENT DOCUMENTS

| | | |
|---|---|---|
| 349384 | 1/1990 | European Pat. Off. . |
| WO9112579 | 8/1991 | European Pat. Off. . |
| 61-296392 | 12/1986 | Japan . |
| 2239961 | 7/1991 | United Kingdom . |

OTHER PUBLICATIONS

Patent Abstract of Japan, vol. 15 No. 058 (E1032) Nov. 1990 Re JP-A 2285799.

Patent Abstract of Japan, vol. 15, No. 246 (E1081), Apr. 1991 Re JP-A 3076500.

Patent Abstract of Japan, vol. 15, No. 170 (E1062), Feb. 1991, Re JP-A 3036897.

Patent Abstract of Japan, vol. 17, No. 068 (M1365), Sep. 1992 Re JP-A 4272416.

*Primary Examiner*—Larry Jones

*Attorney, Agent, or Firm*—Cushman, Darby & Cushman

[57] ABSTRACT

Pressure variation of combustion noise is detected by a microphone set in a combustion chamber, and the pressure propagation characteristic for the path from the gas flow control valve to the microphone is identified while the combustion apparatus is operating, and then an adaptive control is made using one signal detected by an microphone and the other signal produced by passing the signal of the microphone through a filter, and then a corrected anti-phase signal of a combustion noise is computed by the coefficient updating circuit, and the computed result is inputted to a gas flow control valve.

7 Claims, 25 Drawing Sheets

Output waveform of fixed filter

Output waveform of anti-phase signal

Anti-phase pressure waveform propagating down to the combustion chamber (solid line)

ADAPTIVE NOISE SILENCING SYSTEM OF COMBUSTION APPARATUS

FIELD OF THE INVENTION AND RELATED ART STATEMENT

1. Field of the Invention

The present invention relates to a combustion apparatus provided with a function of noise silencing, by which the combustion noise of a small-size combustion apparatus burning gas or others as its fuel is suppressed. The noise suppression is made by a phase interference based on a computation of signal of anti-phase with respect to pressure variations caused by the combustion in accordance with the adaptive type active control.

2. Description of the Related Art

As a prior art, as shown in a patent U.S. Pat. No. 5,145,355, there is a conventional example in which noise is suppressed by the active control using a feedback control of pressure variations caused by the combustion. As is shown in FIG. 21, signal of pressure variations in a chamber 1 detected by a microphone 5 is delayed by a control means 6, and applied to a monitoring means 8 as an anti-phase signal. At the monitoring means 8, a pressure variation of anti-phase on fuel is generated and mixed with air at a burner part 4, and thereby the pressure variation in the chamber 1 is suppressed by the phase interference.

In the above-mentioned constitution, however, the pressure variations detected by a microphone 5 is only applied to the monitoring means 8 after a time delay, and there is no disclosure on a control for realizing an optimum control effect on pressure variations in the chamber 1 accompanied with a consideration on the pressure propagation characteristics for a range from the monitoring means 8 to the microphone 5. That is, first, it is assumed that a fuel supply line 3 from the monitoring means 8 to the microphone 5 has a pressure propagation characteristic i.e., the acoustic wave propagation characteristics as is shown in FIG. 22(*a*). This graph shows a pressure waveform caused by such as an output characteristic of the monitoring means 8 and a resonance characteristic occurring in a space for a range from the monitoring means 8 to the chamber 1. In the graph of FIG. 22(*a*) the abscissa is graduated with time and the ordinate by pressure level. Even by optimally adjusting the amplitude and the phase of a pressure signal in the chamber 1 detected by the microphone 5 indicated by a broken line in FIG. 22(*b*) by the control means 6 and thereby to minimize the signal detected by the microphone 5 by feeding the above-mentioned optimally adjusted pressure signal indicated by a solid line in FIG. 22(*b*) to the monitoring means 8, a complete cancellation of the pressure difficult is difficult. That is, a resulted actual pressure level in the chamber 1 becomes a waveform such as shown in FIG. 22(*c*) on which the pressure propagation characteristics shown by hatchings are superimposed, which propagation characteristics makes complete cancellation of the pressure variations difficult. And associated with the amount of combustion, the frequency characteristics or the output characteristics of the combustion noise make variations or fluctuations, but hitherto there is no disclosure yet on procedure of suppressing the pressure variations with a sufficient accuracy corresponding to those above-mentioned characteristic variations.

As for another working example, there is an art disclosed by a British patent a gazette GB2239961-A concerning an active control, in which the instability of the combustion is suppressed. As is shown in FIG. 23, the pressure variation signal detected by a pressure transducer provided in a combustion chamber is amplified and filtered, and thereafter a signal phase-shifted by a phase shifter and amplified by an amplifier is fed to a servo valve. The above-mentioned signal is applied to fuel through the servo valve, and then the pressure variation is transferred to the combustion chamber. Thereby the unstable pressure variation taking place in the combustion chamber is suppressed. In this prior art example, likewise in the aforementioned prior art, consideration is not given on the pressure propagation characteristic for a range from the servo valve to the combustion chamber. This British gazette makes no disclosure for the control realizing an optimum suppression effect on the pressure variations in the combustion chamber. Neither, a procedure of suppressing the pressure variations with a sufficient accuracy corresponding to the variation associated with the amount of combustion is disclosed yet.

Furthermore, as still another prior art example, Japanese Tokkai (Unexamined published patent application) sho 61-296392 discloses an art that is related to the electronic noise silencing system. The art is such that the noise silencing can be made for a non-steady noise taking place inside a conducting duct (conduit) such as a tubing duct by means of an adaptive control based on an electronic noise silencing system. This is a noise silencing procedure using a feed-forward type adaptive active control exemplified by the active noise control (hereinafter ANC). As is shown in FIG. 24 and FIG. 25, noise propagating in a conducting duct is detected by a microphone $M_1$, and an anti-phase signal is computed based on the detected signal using a controller He, then the anti-phase sound is radiated inside the conducting duct by a speaker S provided in the conducting duct, and thereby the noise is suppressed. At this time, the controller He adjusts phase and amplitude of the anti-phase sound so as to decrease the signal detected by a microphone $M_2$ based on the adaptive control rule. And, the output characteristics of the microphone $M_2$ and the speaker S as well as the acoustic propagation characteristics Gt from the speaker S to the microphone $M_2$ is identified as a pressure propagation characteristic Ht under the state of absence of noise in the conducting duct. This identified pressure propagation characteristic Ht is corrected and processed by the controller He, and the resultant signal is issued as a corrected anti-phase signal, thereby to improve the noise silencing effect.

The basic principle of the above-mentioned ANC, however, is the one that takes a constitution of a feed-forward type noise silencing, in which the anti-phase sound is computed and radiated from a speaker S before the arrival of detected noise after propagation. So far there is no prior art using a constitution in which generated noise is suppressed by a feedback fashion. And corrected characteristics are the output characteristics of the microphone $M_2$ and the speaker S as well as the acoustic propagation characteristics Gt for a range from the speaker S to the microphone $M_2$. The corrected pressure propagation characteristics Ht is identified under the state of absence of noise in the conducting duct. Consequently, in case of employing a feedback type control under the situation of presence of noise in the conducting duct in which the sound propagates from speaker S to the microphone $M_2$, there is such a problem that the pressure propagation characteristic to be corrected must be identified under the state of presence of noise. Moreover, in order to suppress the generated wide band irregular noise, it is necessary to compute the anti-phase sound by the controller He and radiate it through the speaker S before the noise detected by the microphone $M_1$ arrives at the speaker S after propagation in the conducting duct. Restriction presented by the signal processing capability of the present day art is only up to several msec. Due to this limit, a distance between the microphone $M_1$ and the speaker S must be more than 1 m, and accordingly it has been said that the suppression of non-steadily continuing noise in a small size home appliances was very difficult.

OBJECT AND SUMMARY OF THE INVENTION

In the present invention, a first object is to suppressing the combustion noise largely by making the fuel control means generate pressure variations of anti-phase therefrom and making the pressure interference in a combustion chamber more effective, considering the pressure propagation characteristics i.e., acoustic wave propagation characteristics for a range from a fuel control means to a pressure detector under the state of combustion; and at the same time to suppress the combustion noise corresponding with a sufficient accuracy to the variations of the combustion noise characteristics by applying the adaptive type active control.

A second object of the present invention is that, by providing an acoustic wave generation means for generating an anti-phase sound in the vicinity of upper side part of an exhaust outlet and providing a second pressure detector between the exhaust outlet and the acoustic wave generation means, a positive-negative doublet sound source is constituted in a manner having the exhaust outlet as a positive sound source and the acoustic generation means as a negative sound source. Thereby, the combustion noise radiated from the exhaust outlet is reduced for all the directions, and at the same time the combustion noise is reduced with a sufficient accuracy corresponding to variations of the combustion noise characteristics.

In order to achieve the above-mentioned first object, a first mode of the apparatus of the present invention comprises: a fuel control means for controlling the amount of fuel supply and a pressure detector for detecting pressure variations caused by the combustion, thereby to cancel the pressure variation by phase interference by means of feedback type control wherein an anti-phase signal is produced based on a signal from the pressure detector and the anti-phase signal is applied to the fuel control means, the combustion apparatus further comprising a pressure propagation characteristic correction means for correcting an influence of a pressure propagation characteristics i.e., the acoustic wave propagation characteristics for a range from the fuel control means to the pressure detector under the state of combustion, adaptive processing means for computing based on the adaptive control rule an anti-phase signal to obtain pressure variations substantially becoming anti-phase at the position of the pressure detector in accordance with both the signal of the pressure detector and the signal of the pressure detector which has passed through the pressure propagation characteristic correction means; and means for applying the signal of the adaptive signal processing device to the fuel control means.

In accordance with the above constitution, the pressure propagation characteristic correction means realizes a pressure propagation characteristic for a range from the fuel control means to the pressure detector under the state of combustion. As a result, variations of the pressure propagation characteristic due to the combustion, propagation characteristics for a range from the fuel control means to the pressure detector, and an electro-acoustical conversion characteristic can be corrected. Thereby the combustion noise can be reduced largely by generating an anti-phase sound accurately. Furthermore, because of using the adaptive type active control, the noise silencing effect can be exhibited all the time also on the variation of the combustion noise.

In order to achieve the second object of the present invention, a second mode of the apparatus of the present invention comprises: a pressure detector for detecting pressure variations caused by the combustion, thereby to cancel the pressure variation by phase interference by means of feedforward type control wherein an anti-phase signal is produced based on a signal from the pressure detector to issue an anti-phase sound; the combustion apparatus further comprising: a first pressure detector for detecting the pressure variation caused by the combustion in a combustion chamber; acoustic wave generation means for generating the anti-phase sound provided at upper side of the exhaust outlet; a second pressure detector provided between and in proximity to the exhaust outlet and the acoustic wave generation means; pressure propagation characteristic correction means for correcting an influence of a pressure propagation characteristics for a range from the acoustic wave generation means to the second pressure detector; adaptive processing means for computing based on the adaptive control rule an anti-phase signal which makes combustion noise cancel by the phase interference in accordance with the signal of the first pressure detector and the signal of the second pressure detector having passed through the pressure propagation characteristic correction means, and thereby to minimize signals to be detected by the second pressure detector; and means for radiating output signal of the adaptive processing device as acoustic wave from the acoustic wave generation means.

In accordance with the above constitution, the pressure propagation characteristic correction means corrects the pressure propagation characteristic i.e., the acoustic wave propagation characteristics for a range from the acoustic wave generation means to the pressure detector and the electro-acoustic conversion characteristic. Then the acoustic wave generation means generates the anti-phase sound with a sufficient accuracy° Since the acoustic wave generation means is provided in the vicinity of the exhaust outlet, constitution becomes a positive-negative doublet sound source. Thereby the combustion noise of low frequencies radiated from the exhaust outlet can be reduced for all the directions. And, in case that, for the combustion noise, the Helmholtz resonance determined by the space of such as the combustion chamber and the exhaust duct is dominant, and the combustion noise can be reduced even when the distance between the first pressure detector and the acoustic wave generation means is made as short as less than 60 cm.

BRIEF DESCRIPTION OF THE DRAWINGS

FIG. 21 is a schematic drawing of a combustion apparatus of the first prior art wherein an active control is applied to.

FIG. 23 is a schematic partial section view of a combustion apparatus of a second prior art wherein an active control is applied to.

FIG. 24 is a schematic drawing of an electronic silencing system of a third prior art wherein an active control is applied to.

It will be recognized that some or all of the Figures are schematic representations for purposes of illustration and do not necessarily depict the actual relative sizes or locations of the elements shown.

DESCRIPTION OF THE PREFERRED EMBODIMENT

<FIRST EMBODIMENT>

In the following, a first working example of the present invention is explained in a case embodied in a small size gas hot-water server for home use shown in FIG. 1 to FIG. 6.

Figure 1:
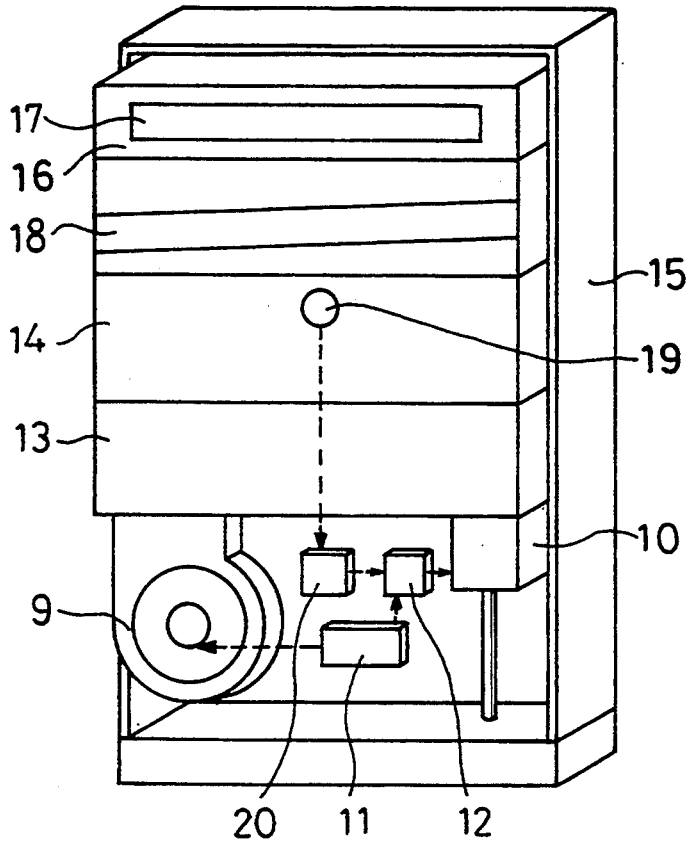
FIG. 1 is a front view of a gas hot water server as a first working example of the combustion apparatus of the present invention.
Figure 2:
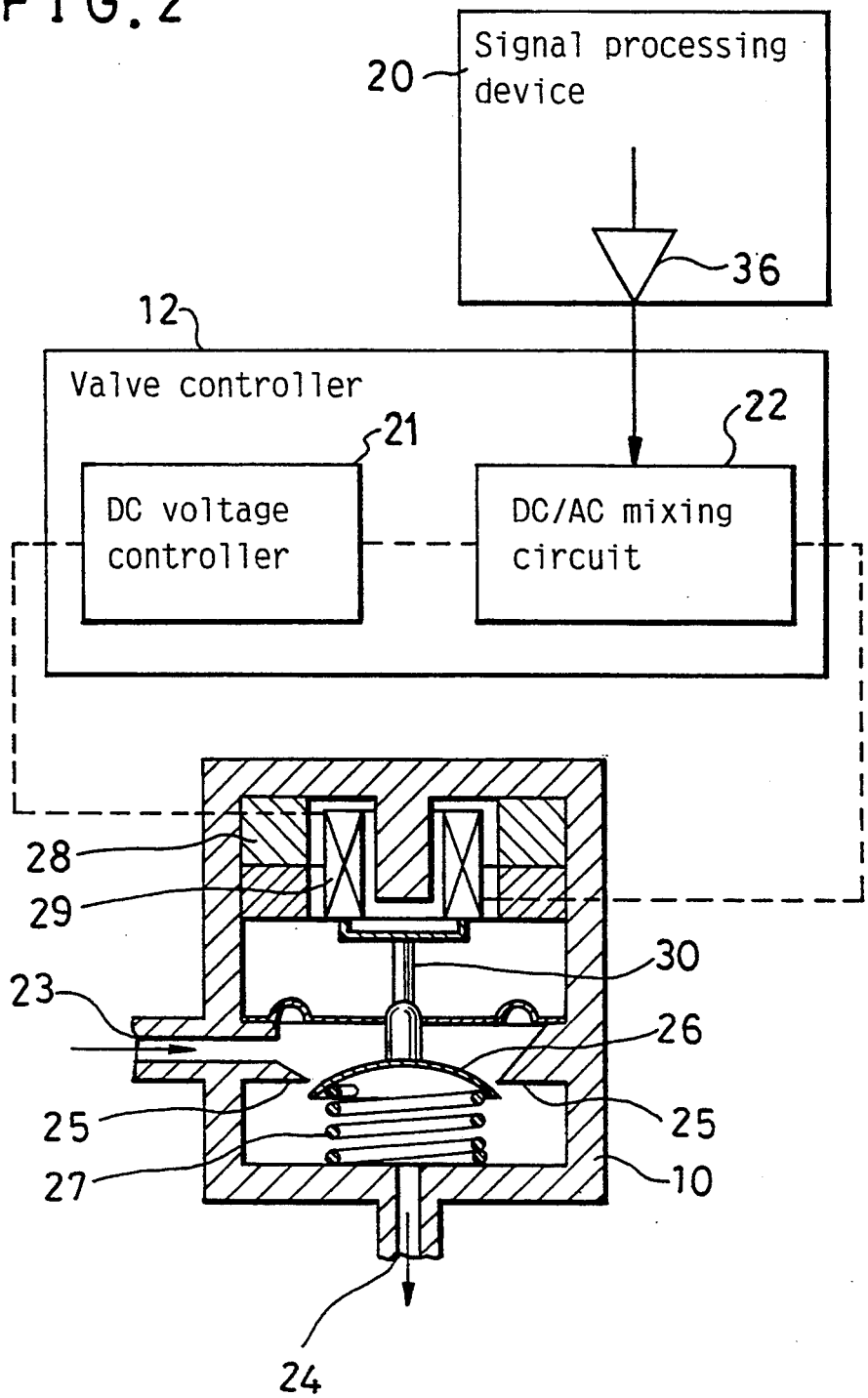
FIG. 2 is an expanded cross-sectional view of a gas flow rate controlling valve with related circuit of the above-mentioned example.

The constitution of the present working example, as shown in FIG. 1 and FIG. 2, comprises in a casing 15: a sirocco fan 9 which is a blower for supplying air for the combustion, a gas flow control valve 10 which is a fuel control means for controlling the flow rate of gas used as a fuel, a main body controller 11 for supplying a combustion rate control signal to the gas flow control valve 10 and the sirocco fan 9. The main body controller controls these for controlling the temperature of served water from the hot water server. The apparatus further comprises a valve controller 12 for controlling the gas flow control valve 10, a mixing chamber 13 for mixing gas and air appropriately, an exhaust duct 16 having an exhaust outlet 17, and a heat exchanger for transferring the heat by the combustion to water. And further the apparatus comprises a microphone 19 which is a pressure detector provided in the combustion chamber 14 for taking out the pressure variation occurring in the combustion, a signal processing device 20 which is an adaptive signal processing means for computing signals substantially becoming anti-phase based on the signal detected by the microphone 19, a DC voltage controller 21 (FIG. 2) for feeding a DC voltage to the valve controller 12 which controls the gas flow rate by driving the gas flow control valve 10, and a DC/AC mixing circuit 22 for superimposing an AC voltage on the above-mentioned DC voltage.

Figure 3:
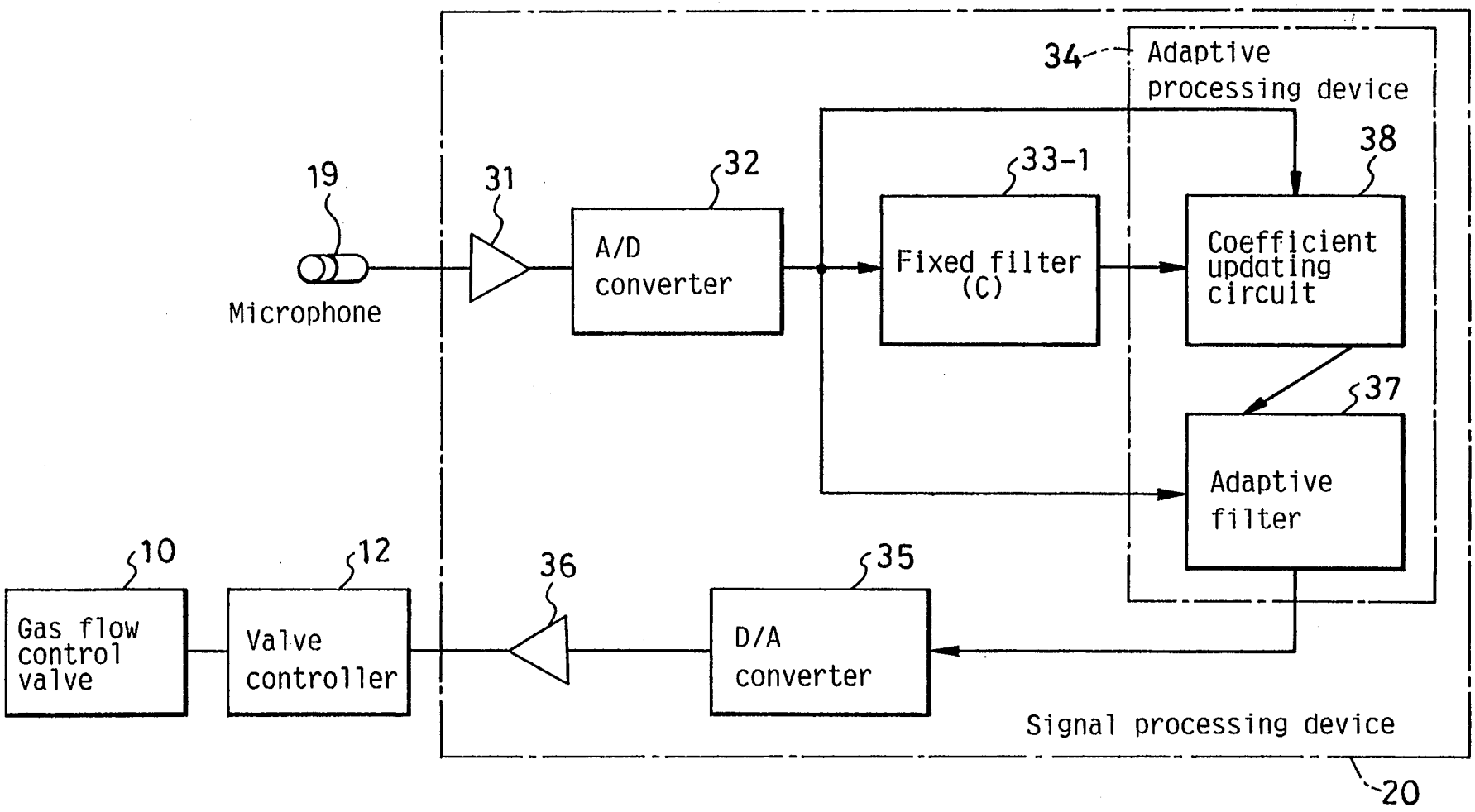
FIG. 3 is a circuit diagram inside a signal processing means of the above-mentioned example.

Hereupon, the gas flow control valve 10 is, as shown in FIG. 2, of a moving coil type, which is superior in quick response characteristic because of its light-weight weight driven element. It comprises a gas inlet port 23, a valve seat 25, a valve body 26, a spring 27 for pushing up the valve body 26, a magnet 28 and a coil 29 for pushing down-the valve body 26, and a shaft 30 for connecting the coil 29 and a valve body 26. Furthermore, the above-mentioned signal processing device 20 comprises as shown in FIG. 3, a first amplifier 31 for amplifying a signal from the microphone 19, an A/D converter 32 for converting an analog signal to a digital signal, a fixed filter 33-1 which is a pressure propagation characteristic correction device composed of an FIR (Finite Impulse Response) filter for filtering one of three signals divided from the signal from the A/D converter 32, an adaptive processing device 34 for computing the anti-phase signal based on the signal passed through the above-mentioned fixed filter 33-1 and other remaining two signals of those three signals, a D/A converter 35 for converting the anti-phase digital signal obtained above into an analog signal, and a second amplifier 36 amplifying signal from the D/A converter 35. The adaptive processing device 34 further comprises an adaptive filter 37 which is realized by an FIR filter whose coefficients are changeable and a coefficient updating circuit 38 whereby the coefficients of the adaptive filter 37 are updated and also whereinto a least-mean-square algorithm is installed.

Figure 4:
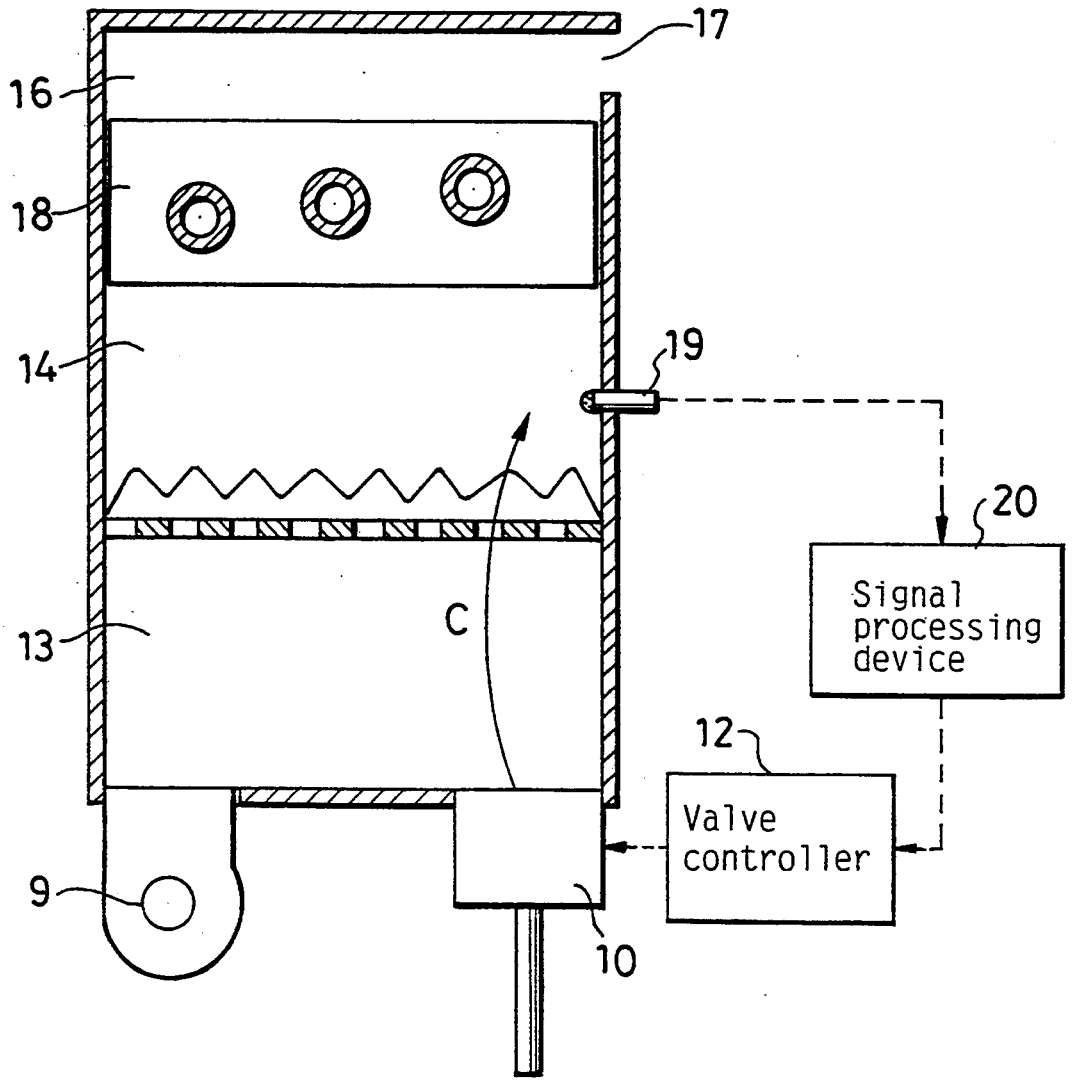
FIG. 4 is a schematic drawing of internal constitution of the above-mentioned apparatus.
Figure 5:
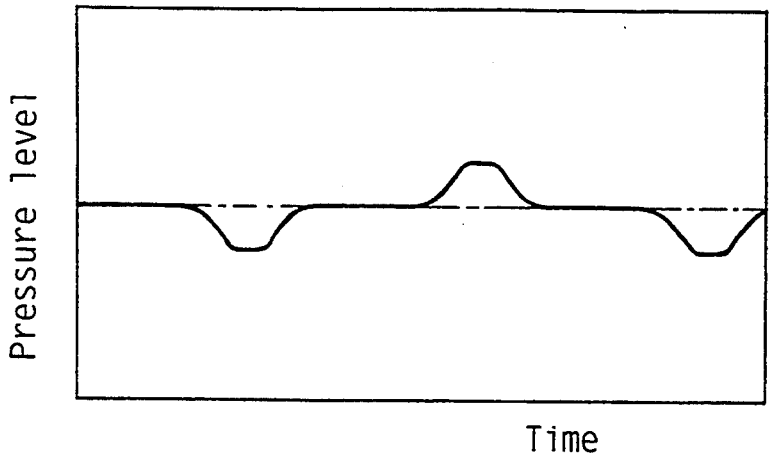
FIG. 5(*a*), FIG. 5(*b*) and FIG. 5(*c*) are graphs of waveforms of pressure levels showing principle of noise silencing of the above-mentioned example.
Figure 5:
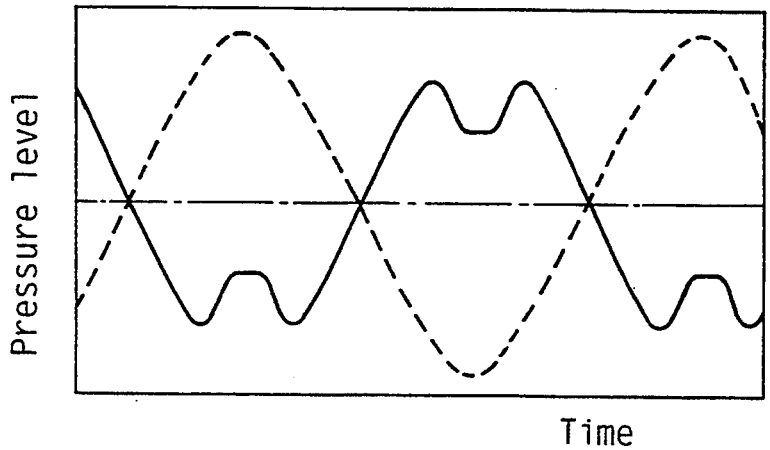
Figure 5:
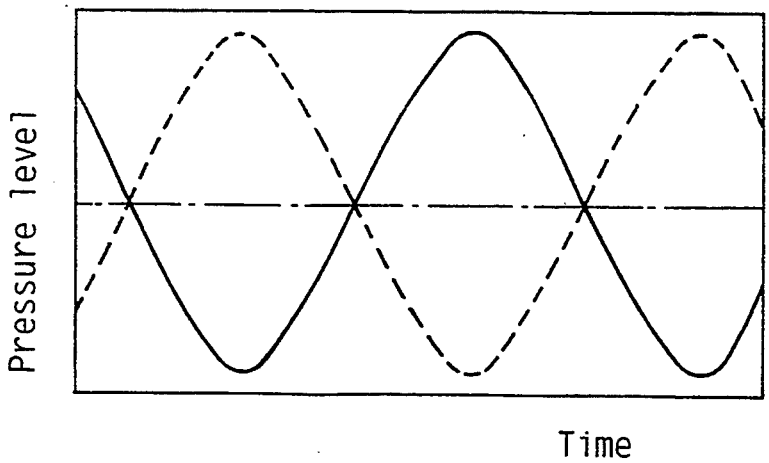

In accordance with the constitution described above, the action and the effect described below are exhibited. First, explanation is given on an operation in which an anti-phase signal is applied on combustible gas as the pressure variation. The anti-phase signal computed by the signal processing device 20 is inputted to the DC/AC mixing circuit 22 of the valve controller 12 and outputted into the gas flow through the gas flow control valve 10, as the pressure variation. Hereupon, in accordance with the instruction of the main body controller 11, the gas flow control valve 10 controls the combustion rate in a manner to keep the gas flow rate constant. This is achieved by balancing between a upward force acted from the spring 27 and a pushing down force of the valve body 26 by a force given through the shaft 30 caused by the action of an electromagnetic force induced by the magnet 28 and the coil 29, depending on a DC voltage supplied from the DC voltage controller 21. Thereby the gap between the valve seat 25 and the valve body 26 is kept to a constant spacing. Under the state of keeping the constant spacing, by such action that the corrected anti-phase signal which has been mixed in the DC/AC mixing circuit 22 is inputted in the coil 29, the valve body 26 makes vibration by the action of the electromagnetic force. Thereby the spacing between the valve seat 25 and the valve body 26 also vibrates, and a pressure variation can be superimposed on gas. Next, explanation is given on the action and the effect of computation of the anti-phase signal and the suppression of the combustion noise. The fixed filter 33-1 is such one that has been made by identifying the pressure propagation characteristic C from the gas flow control valve 10 to the microphone 19 under the state where the gas hot water server is already being operated and the combustion is being made as shown in FIG. 4. Therefore, this pressure propagation characteristic C (in FIG. 3) includes such as an electrical signal to pressure variation conversion characteristic of the gas flow control valve 10, a sound pressure variation to electrical signal conversion characteristic of the microphone 19, a resonance characteristic occurring during the pressure propagation from the gas flow control valve 10 to the microphone 19, and variations of phase and amplitude characteristic occurring at the time when the pressure variation passes through a flame.

Next, from the signal of the pressure variation in the combustion chamber 14 detected by the microphone 19, an influence of the pressure propagation characteristic C at the time of combustion is corrected by the fixed filter 33-1; and based on this signal, a corrected anti-phase signal is computed by the adaptive processing device 34. Thus a corrected anti-phase output waveform shown by a solid line of FIG. 5(*b*) can be computed. Signal shown by this solid line of FIG. 5(*b*) is outputted to the gas flow control valve 10, thereby producing a pressure variation in the fuel, and the output waveform of the pressure propagation characteristic C shown by FIG. 5 (*a*) which has been used for correction is superimposed during the while the above-mentioned pressure variation propagates down to the combustion chamber As a result, such pressure variation waveform as shown by the solid line of FIG. 5(*c*) (that which is obtainable by inverting the phase of the pressure waveform detected in the combustion chamber 14 shown by the dotted line) can effectively be realized in the combustion chamber 14. That is, since the pressure variation substantially becoming anti-phase to that occurring in the combustion chamber 14 can be realized with a sufficient accuracy in the combustion chamber 14, the pressure variation can be suppressed by the phase interference, thereby the combustion noise can be reduced largely.

Figure 6:
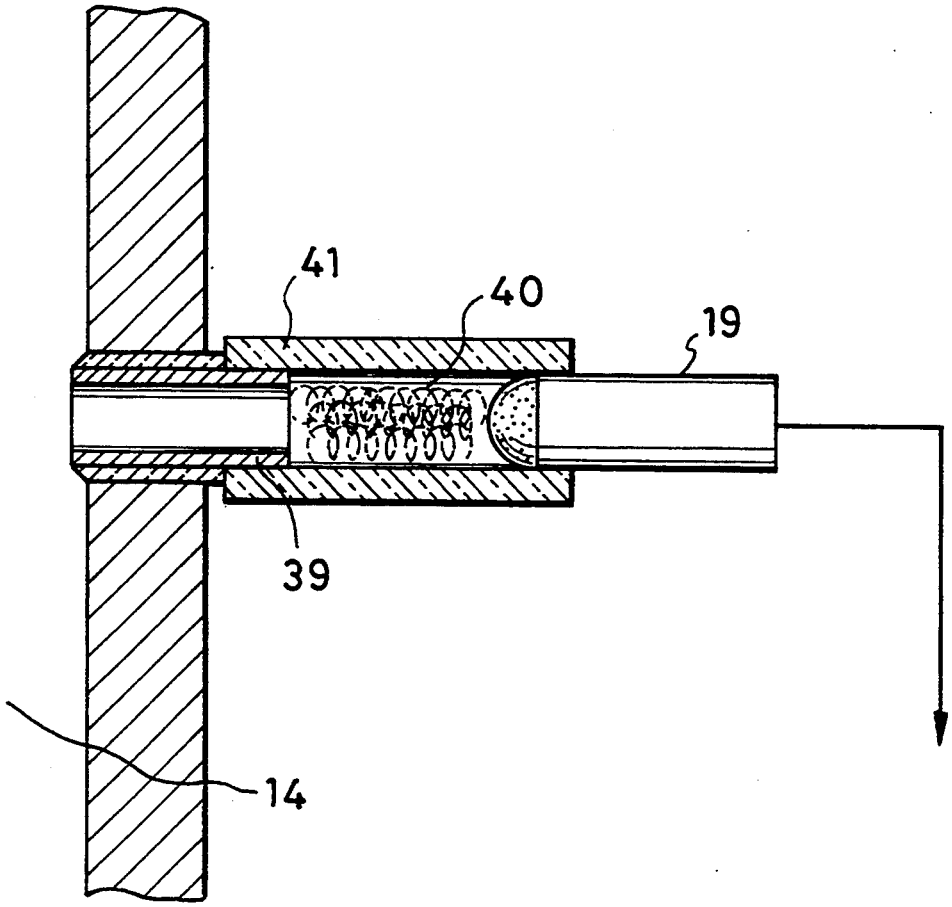
FIG. 6 is a cross-sectional view of installation of a microphone of the above-mentioned example.

Moreover, in the adaptive processing device 34, the coefficients of the adaptive filter 37 are updated by the least-mean-square algorithm of the coefficient updating circuit 38 in a manner that the combustion noise detected by the microphone 19 becomes minimum, and thus the corrected anti-phase signal is computed in real time. Therefore, even when the combustion level is changed and hence the combustion noise characteristic varies, the silencing effect can act regardless of the combustion state. And further, since the gas flow control valve 10 is used as a control actuator, control of the combustion rate and the suppression of the combustion noise can be achieved by a single valve. Moreover, for the anomalous combustion in which a large amount of $NO_x$ and/or CO are produced in the exhaust gas and the combustion noise is large, when the microphone 19 detects a sound pressure exceeding a predetermined threshold, it is judged that an anomalous combustion takes place, and production of $NO_x$ and/or CO can be suppressed by controlling the gas flow. That is, by the instruction of a main body controller 11, the voltage applied to the DC voltage controller 21 of a valve controller 12 is changed and the fuel flow rate is controlled. Thereby, the rotation speed of the sirocco fan 9 is controlled and the air supply rate can be controlled. And thus the occurrence of the anomalous combustion is prevented, and suppressing the yield of $NO_x$ also becomes possible. And, as is shown in FIG. 6, a microphone 19 has a constitution that a pressure intake tap 39 is attached to the combustion chamber 14, and this pressure intake tap 39 and the microphone 19 are connected by a silicon tube 41 in which glass wool 40 is filled. By this configuration, in comparison with a constitution that the microphone 19 is attached directly to the combustion chamber 14, it is possible to reduce the characteristic degradation of the microphone 19 due to heat from 14. And, possible adverse effect to the acoustic transfer characteristic of standing-wave resonance occurring inside the silicon tube 14 is also reduced by the sound absorbing property of the glass wool 40.

Apart from the afore-mentioned example in which the least-mean- square method was used as for the method for making the detected signal energy minimum was taken up, the maximum likelihood estimate method, or other estimate methods can exhibit the similar effect. Furthermore, since those signals detected in the combustion chamber 14, in the mixing chamber 13, and in the exhaust duct 16 have mutually high correlations, a configuration that the microphone 19 is provided in the mixing chamber 13 or in the exhaust duct 16 also exhibits the similar effect. Moreover, apart form the above-mentioned configuration of using the microphone 19 as the pressure detector, other detectors can be used for detecting other physical variations caused by the fire flame of the combustion such as a vibration detector for detecting the vibration associated with the fire flame on the outer wall, in the combustion chamber 14, or an optical detector for detecting the light radiated from the fire flame, or an ion current detector for detecting an ion current flowing corresponding to the chemical reaction of the combustion, also exhibiting the similar effect.

<SECOND EMBODIMENT>

Figure 7:
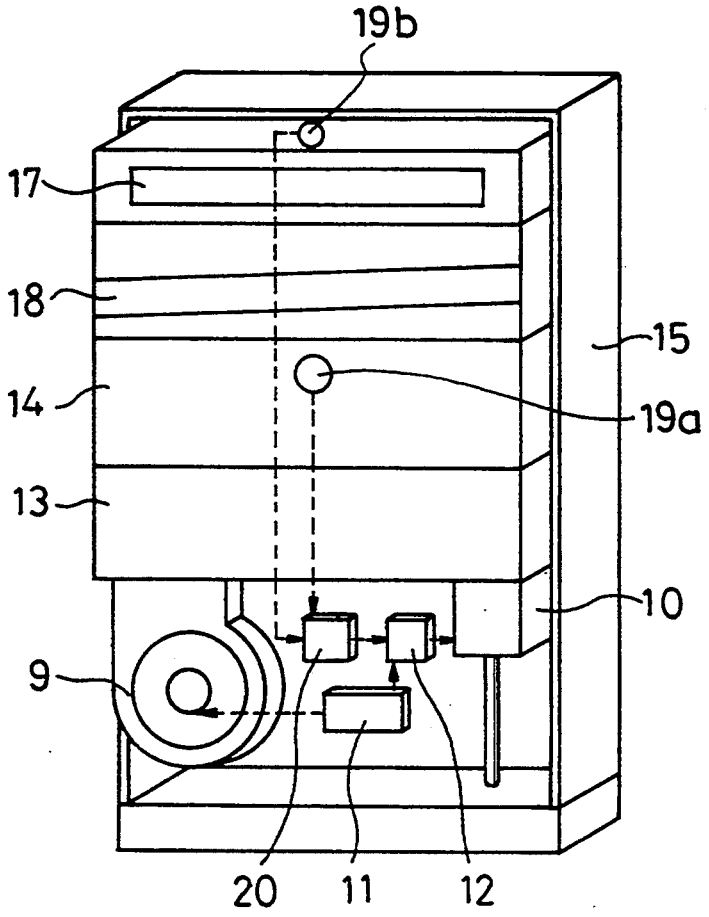
FIG. 7 is a front view of a gas hot water server as a second working example of the combustion apparatus of the present invention.
Figure 8:
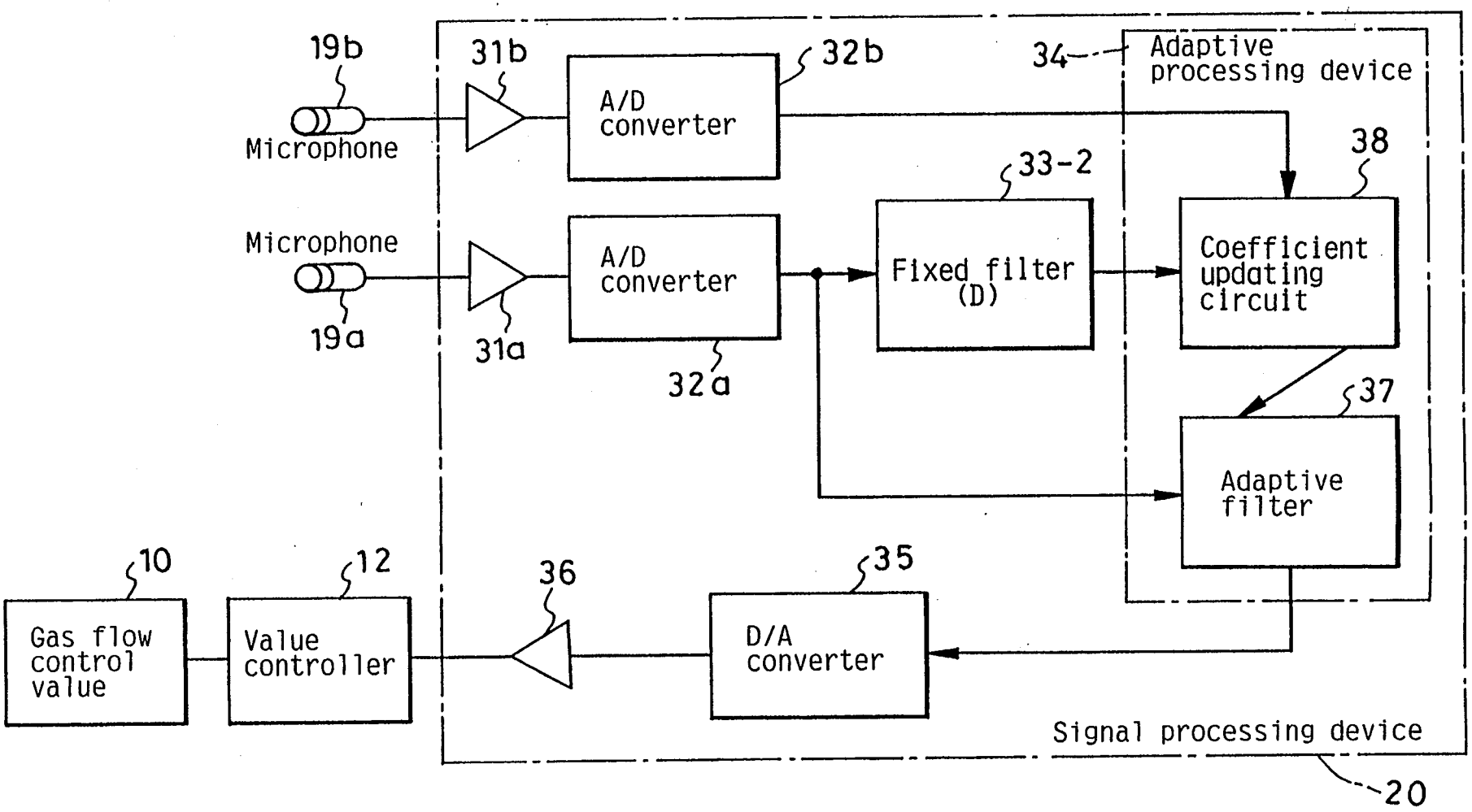
FIG. 8 is a circuit diagram inside a signal processing means of the above-mentioned example.

Next, the second working example of the present invention is explained referring to FIG. 7 and FIG. 8. To those parts having the same construction and performing the same function as in the first working example described above, the same numerals are given and detailed explanations on those parts are omitted, and the explanation is given mainly on the parts differing from the first working example.

As is shown in FIG. 7 and FIG. 8, the constitution of the present working example comprises: a first microphone 19*a* provided in a combustion chamber 14, a second microphone 19*b* provided at the upper part of an exhaust outlet 17, a first amplifier 31*a* for amplifying the signal detected by the first microphone 19*a*, a first A/D converter 32*a* for converting this signal to a digital signal, a second amplifier 31-*b* for aplifying the signal detected by the second microphone 19*b*, a second A/D converter 32*b* for converting this signal to a digital signal, a fixed filter 33-2 for issuing the anti-phase signal, an adaptive processing device 34 having therein an adaptive filter 37, and a coefficient updating circuit 38 for updating the coefficient. The fixed filter 33-2 for realizing the pressure propagation characteristic at the time of combustion is the one which is resulted by identifying the pressure propagation characteristic D of, such as, electrical signal to pressure variation conversion characteristic of the gas flow control valve 10, a sound pressure variation to electrical signal conversion characteristic of the microphone 19*b*, a resonance characteristic occurring during the pressure propagation for a range from the gas flow control valve 10 to the microphone 19*b*, and variations of pressure variation characteristic occurring at-the time when the pressure variation passes through the flame.

In accordance with the above-mentioned constitution, pressure variation occurring in the combustion chamber 14 is detected by the first microphone 19*a*, and the combustion noise radiated from an exhaust outlet 17 is detected by the second microphone 19*b* provided at the upper part of the exhaust outlet 17. The signal detected by the first microphone 19*a* passes through the first amplifier 31*a* and the first A/D converter 32*a* and divided into two. One signal is taken into the fixed filter 33-2, other signal is taken into the adaptive filter 37. At the coefficient updating circuit 38, signal passed through the fixed filter 33-2 and signal detected by the second microphone 19*b* are taken into it. The coefficient updating circuit 38 installs therein a least-mean-square algorithm by which the squared values of errors of signal detected by the second microphone 19*b* become minimum, and therein the coefficients of the adaptive filter 37 are updated in a manner that the phase characteristic of the signal detected by the first microphone 19*a* is inverted. The signal detected by the first microphone 19*a* is inputted into the fixed filter 33-2, in which the pressure propagation characteristic is realized and a digital anti-phase signal of corrected anti-phase characteristic is issued from the adaptive processing device 34. This corrected anti-phase signal is outputted to the combustible gas as a pressure variation. On the corrected anti-phase pressure variation impressed on gas, the effect of pressure propagation characteristic is further superimposed during the propagation process down to the combustion chamber 14, thus it becomes effectively anti-phase in the combustion chamber, and the pressure variation is suppressed by the phase interference. The adaptive processing device 34 performs the control in a manner that the sound pressure impressed on the second microphone 19*b* detected at the exhaust outlet 17 becomes minimum at the exhaust outlet 17, from which most of the combustion noise is radiated, and therefore the combustion noise can be suppressed certainly.

<THIRD EMBODIMENT>

Figure 9:
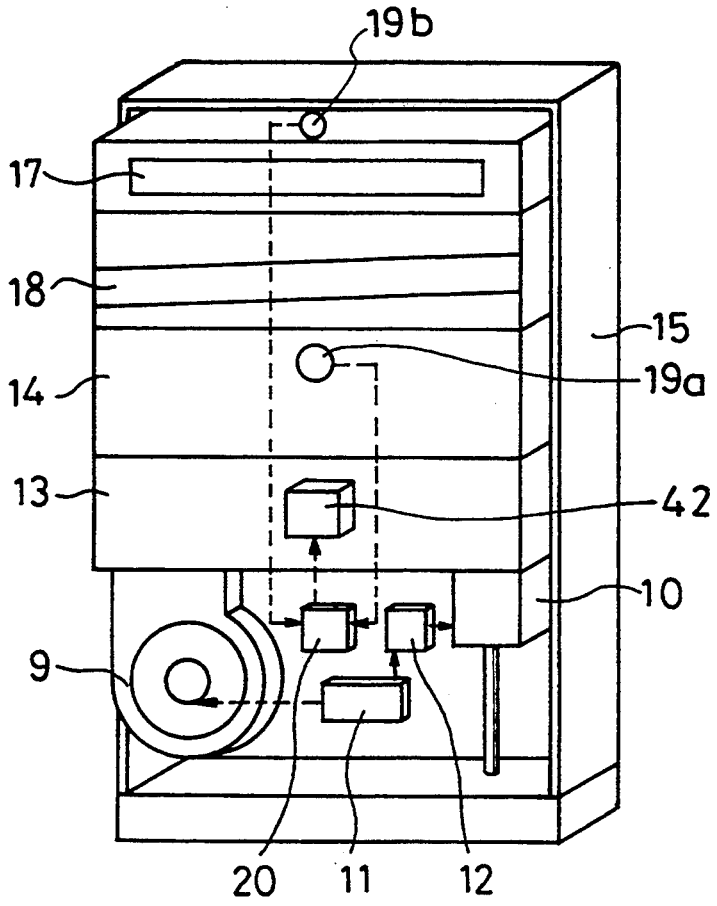
FIG. 9 is a front view of a gas hot water server as a third working example of the combustion apparatus of the present invention.
Figure 10:
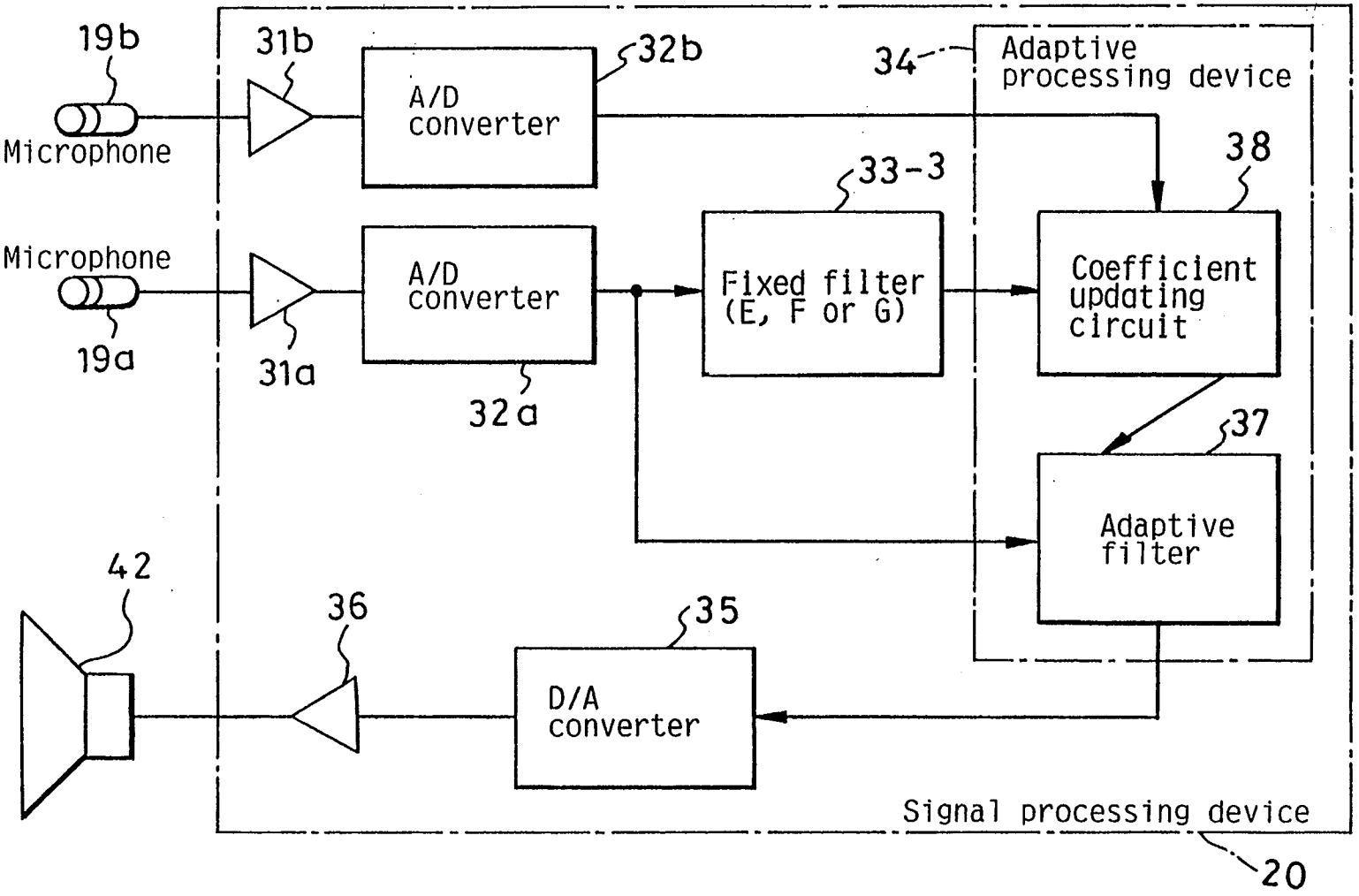
FIG. 10 is a circuit diagram inside a signal processing means of the above-mentioned example.

Next, a third working example of the present invention is explained referring to FIG. 9 and FIG. 10. To those parts having the same construction and performing the same function as in the first working example described earlier, the same numerals are given and detailed explanations on those parts are omitted. And the explanation is given mainly on the parts differing from the first working example.

As is shown in FIG. 9 and FIG. 10, the constitution of the present working example comprises: a first microphone 19*a* provided in a combustion chamber 14, a second microphone 19*b* provided at the upper part of an exhaust outlet 17, a mixing chamber 13 for mixing fuel air and located at upper stream side of the flame, a speaker 42 which is an acoustic wave generation means, a first amplifier 31*a* for amplifying the signal detected by the first microphone 19*a*, a first A/D converter 32*a* for converting this signal to a digital signal, a second amplifier 31*b* for amplifying the signal detected by the second microphone 19*b*, a second A/D converter 32*b* for converting this signal to a digital signal, a fixed filter 33-3 for issuing the anti-phase signal, an adaptive processing device 34 for issuing an anti-phase signal, an adaptive filter 37 provided in the adaptive processing device 34 and a coefficient updating circuit 38. The fixed filter 33-3 identifies and realizes the acoustic transfer characteristic E from the speaker 42 to the second microphone 19*b*.

In accordance with the above-mentioned constitution, the pressure variation occurring in the combustion chamber 14 is detected by the first microphone 19*a*, the combustion noise radiated from the exhaust outlet 17 is detected by the second microphone 19*b* provided at the upper part of 17. The signal detected by the first microphone 19*a* passes through the first amplifier 31*a* and the first A/D converter 32*a* and divided into two. One signal is taken into the fixed filter 33-3, other signal is taken into the adaptive filter 37. The fixed filter 33-3 is composed of an FIR filter realizing an acoustic transfer characteristic E at the time of combustion from the speaker 42 down to the second microphone 19*b*. At the coefficient updating circuit 38, signal passed through the fixed filter 33-3 and signal detected by the second microphone 19*b* are taken into it. Since the coefficient updating circuit 38 installs a least-mean-square algorithm, which is the adaptive control rule whereby the squared values of errors of signal detected by the second microphone 19*b* become minimum, the coefficients of the adaptive filter 37 are updated in a manner that the phase characteristic of the signal detected by the first microphone 19*a* is inverted.

At the adaptive processing device 34, signal detected by the first microphone 19*a* is inputted into the adaptive filter 37 which is for realizing the anti-phase characteristic, and a digital anti-phase signal of corrected anti-phase characteristic is issued. This corrected anti-phase signal is converted into analog signal by the D/A converter 35, amplified by the second amplifier 36 and inputted into the speaker 42. Then, the speaker 42 outputs a pressure variation, which is of corrected anti-phase to the sound generated from the flame vibration, is outputted into the gas-air mixed gas. The pressure variation of the corrected anti-phase superimposed on the mixed gas propagates down to the combustion chamber 14, and the pressure variation is suppressed by the phase interference.

Furthermore, since the adaptive processing device 34 performs the control in a manner to minimize the sound pressure impressed on the second microphone 19*b* detected at the exhaust outlet 17 by driving the speaker 42, the suppression of the combustion noise can be made certainly at the exhaust outlet 17, from which most of the combustion noise is radiated. Hereupon, by installing a speaker 42 in the mixing chamber 13, it becomes possible to apply the anti-phase sound over the whole volume of gas for the combustion. Thereby, as compared with a prior art constitution in which the anti-phase sound is applied only on fuel and air, the combustion noise can be suppressed more efficiently. Moreover, since the noise detected by the first microphone 19*a* includes not only combustion noise but also blower noise generated by the sirocco fan 9, the speaker 42 can also silence the blower noise.

<FOURTH EMBODIMENT>

Figure 11:
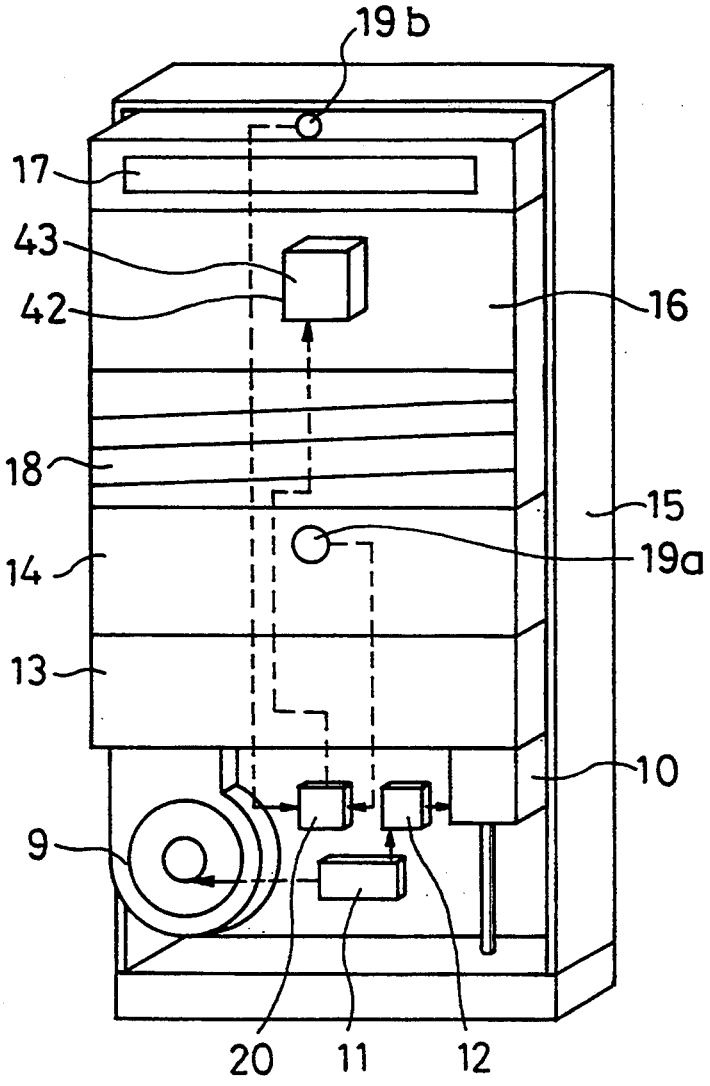
FIG. 11 is a front view of a gas hot water server as a fourth working example of the combustion apparatus of the present invention.
Figure 12:
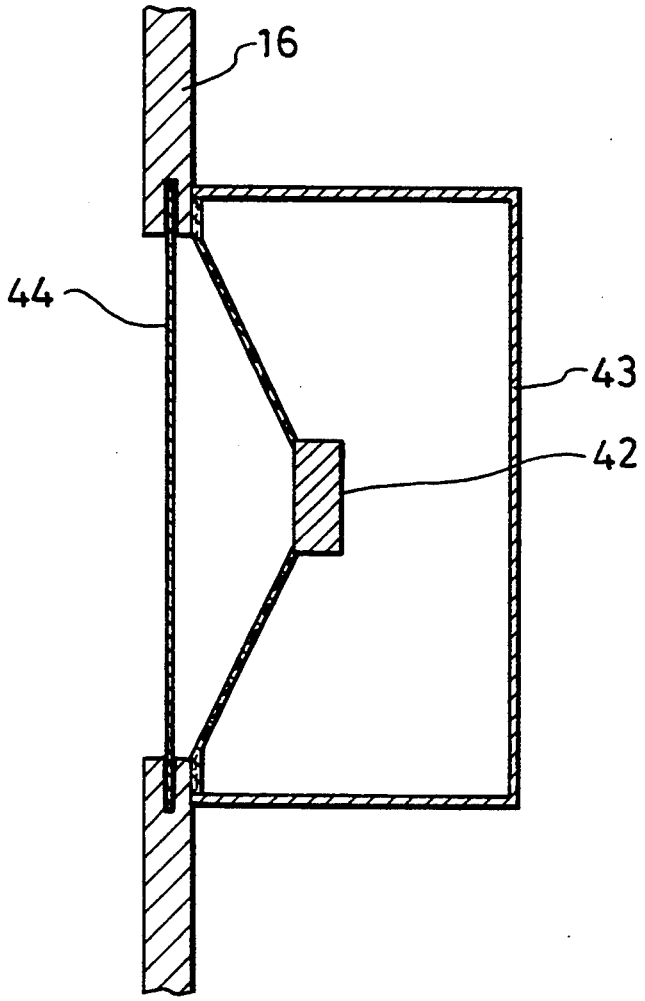
FIG. 12 is a cross-sectional view of installation of a speaker of the above-mentioned example.

Next, the fourth working example of the present invention is explained referring to FIG. 11 and FIG. 12. To those parts having the same construction and performing the same function as in the first working example, described earlier, the same numerals are given and detailed explanations on those parts are omitted. And the explanation is given mainly on the parts differing from the first working example.

As is shown in FIG. 11 and FIG. 12, the constitution of the present working example comprises: a first microphone 19*a* provided in a combustion chamber 14, a second microphone 19*b* provided at the upper part of an exhaust outlet 17, and a speaker 42 provided in the exhaust duct at the down stream side of the flame as an acoustic wave generation means for generating acoustic wave of an anti-phase into an exhaust duct 16. At this time, the distance between the first microphone 19*a* and the speaker 42 is as short as less than several 10 cm. And, the fixed filter 33-3 (shown in FIG. 10) identifies and realizes the acoustic transfer characteristic F on which the acoustic output from the speaker 42 propagates down to the second microphone 19*b*. Furthermore, it is constituted by covering the speaker 42 with a speaker box 43, and, by providing a heat-resistive thin vibration plate 44 between the exhaust duct 16 and the speaker 42 at the same tame.

Figure 13:
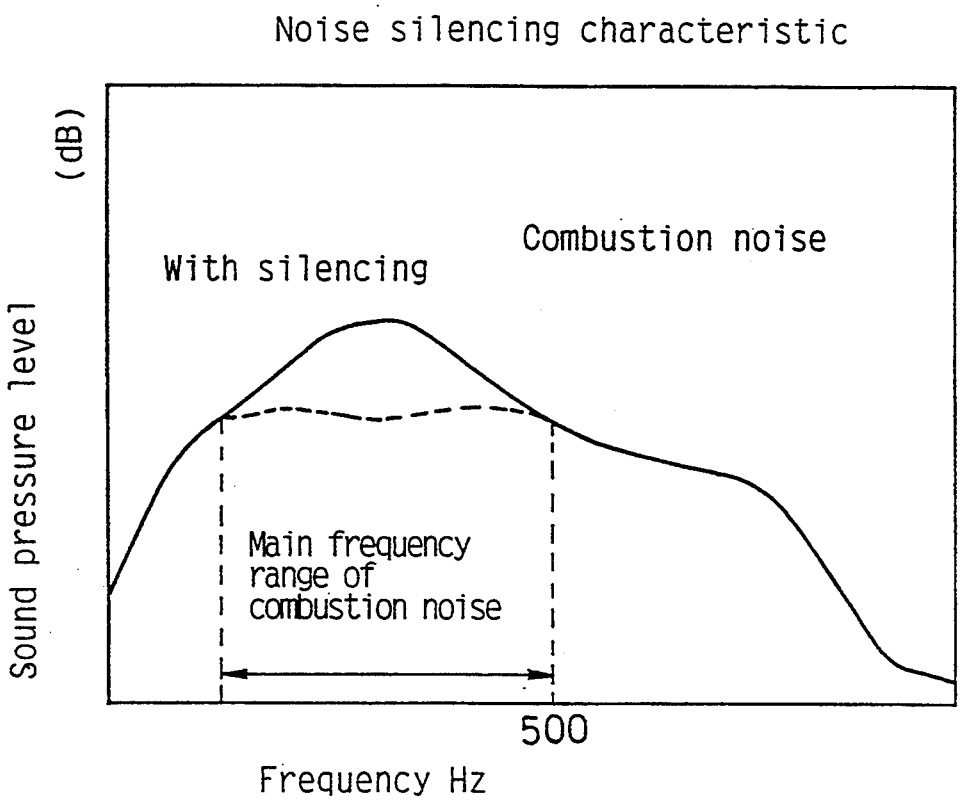
FIG. 13 is a noise silencing-characteristic of the above-mentioned example.

In accordance with the above-mentioned constitution, signal detected by the first microphone 19*a* is, as is shown in FIG. 10, divided into two. One signal is taken into the fixed filter 33-3, and the other signal is taken into the adaptive filter 37. The fixed filter 33-3 is composed of an FIR filter for realizing an acoustic transfer characteristic F at the time of combustion for a range from the speaker 42 down to the second microphone 19*b*. Signal detected by the first microphone 19*a* is inputted into the adaptive filter 37, and a digital anti-phase signal of inverted characteristic is issued therefrom. This corrected anti-phase signal is converted into analog signal by the D/A converter 35, after amplified by the second amplifier 36, inputted into the speaker 42, and then, sound of corrected anti-phase to what is generated from the flame vibration is generated from the speaker 42. At this time, the acoustic wave makes the thin vibrating plate 44 vibrate, thus to issue the acoustic wave from the thin vibrating plate 44 into the exhaust gas in the exhaust duct 16. The sound substantially becoming anti-phase is generated from the speaker 42 when the combustion noise generated due to the fire flame propagates in the exhaust duct 16, and thereby the combustion noise is canceled by the phase interference action. That is, a feedforward control acts on the speaker 42 in a manner to minimize the sound pressure impressed on the second microphone 19*b* detected at the exhaust outlet 17, and the combustion noise radiated from the exhaust outlet 17 can be suppressed as is shown in FIG. 13.

Hereupon, in a system in which periodic noises are removed and a control system based on the ANC (Active Noise Control) is applied, it is said that, at least several msec is necessary for the time period which starts from the detection of noise, performs the computation of the anti-phase based on the detected signal and finishes the issuing of the sound from the speaker 42. That is, in order to silence the noise detected by the first microphone 19*a* by the speaker 42, more than 1 meter is required for the distance between the first microphone 19*a* and the speaker 42. However, the inventor found by experiment that the silencing of noise was possible by a distance less than 60 cm. The reason is estimated that, for the combustion noise occurring in small size gas hot water servers or the likes, fluctuating sound generated by the Helmholtz resonance determined by the volume of the mixing chamber 13 and the combustion chamber 14 as well as by the length of the exhaust duct 16 is dominant. Even during the time which is not sufficient to cover the computation time (about 1 msec), for the noise whose main components are the resonating sound of low frequency range, the noise silencing effect can be exhibited by predicting the succeeding variation, hence it makes the noise silencing possible with a short distance less than several ten cm. Hereupon, when the Helmholtz resonance occurs, particle velocity takes its maximum value at such part of the exhaust duct 16 that the cross-sectional area of the duct is smallest. Since the speaker 42 is provided in the exhaust duct, the acoustic impedance can be changed by 42, and thus the resonance sound can be reduced.

<FIFTH EMBODIMENT>

Figure 14:
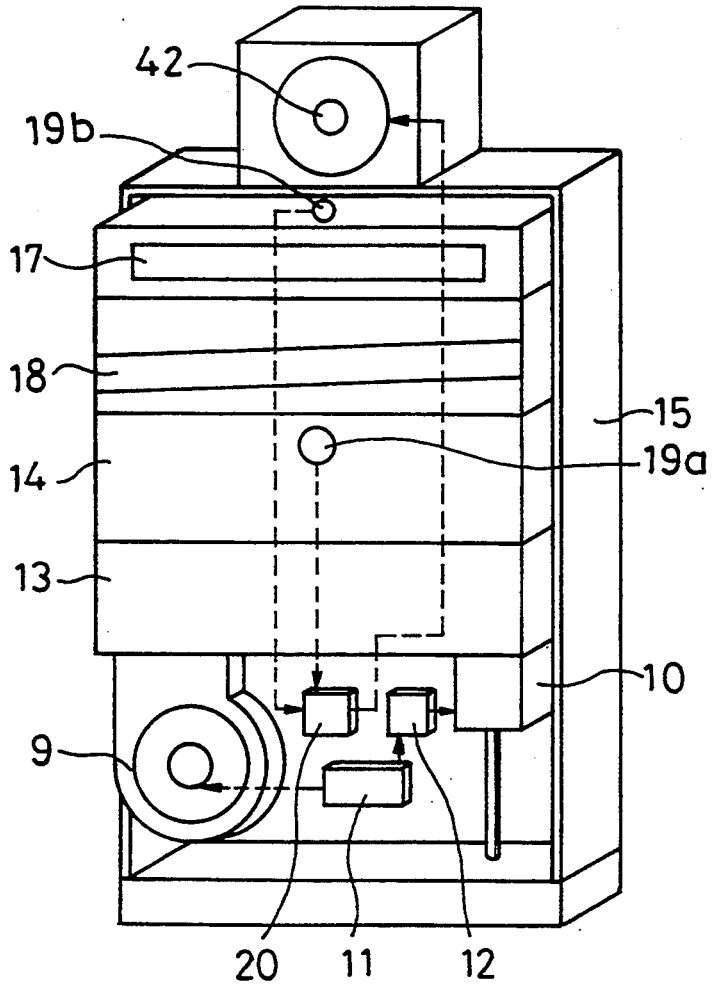
FIG. 14 is a front view of a gas hot water server as a fifth working example of the combustion apparatus of the present invention.

Next, the fifth working example of the present invention is explained referring to FIG. 14. To those parts having the same construction and performing the same function as those in the fourth working example described above, the same numerals are given and detailed explanations on those parts are omitted. And the explanation is given mainly on the parts differing from the fourth working example.

As is shown in FIG. 14, the constitution of the present working example comprises: a first microphone 19*a* provided in a combustion chamber 14, a speaker 42 provided on the upper side of an exhaust outlet 17 as an acoustic wave generation means for generating sound of an anti-phase, a second microphone 19*b* provided at a center on a line connecting the center of the speaker 42 and the center of the exhaust outlet 17, a first amplifier 31*a* (FIG. 10) for amplifying the signal detected by a first microphone 19*a*, a first A/D converter 32*a* for converting this signal to a digital signal, a second amplifier 31*b* for amplifying the signal detected by the second microphone 19*b*, a second A/D converter 32*b* for converting this signal to a digital signal, an adaptive processing device 34 including an adaptive. filter 37 therein for issuing an anti-phase signal, a fixed filter 33-3, and a coefficient updating circuit 38. The fixed filter 33-3 identifies and realizes the acoustlc transfer characteristic G for the sound path for a range from the speaker 42 to the second microphone 19*b*. At this time, the distance between the first microphone 19*a* and the speaker 42 is as short as less than 60 cm.

In accordance with the above-mentioned constitution, the pressure variation occurring in the combustion chamber 14 is detected by the first microphone 19*a*, the combustion noise radiated from the exhaust outlet 17 is detected by the second microphone 19*b* provided at the upper part of the exhaust outlet 17. The signal detected by the first microphone 19*a* passes through the first amplifier 31*a* and the first A/D converter 32*a* and divided into two. One signal is taken into the fixed filter 33-3, and the other signal is taken into the adaptive filter 37. The fixed filter 33-3 is composed of an FIR filter realizing an acoustic transfer characteristic G for a range from the speaker 42 down to the second microphone 19*b*. At the coefficient updating circuit 38, signal passed through the fixed filter 33-3 and signal detected by the second microphone 19*b* are taken into it. And a least-mean-square algorithm, which is the adaptive control rule, by which the squared values of errors of signal detected by the second microphone 19*b* become minimum is installed in the coefficient updating circuit 38. Therefore the coefficients of the adaptive filter 37 are updated in a manner that the phase characteristic of the signal detected by the first microphone 19*a* is inverted. Into the adaptive filter 37 in which the corrected inverted characteristic is realized, the signal detected by the first microphone 19*a* is inputted, and digital anti-phase signal of corrected inverted characteristic is outputted. This corrected anti-phase signal is converted into analog signal by the D/A converter 35, and then amplified by the second amplifier 36. Then, the amplified signal is inputted into the speaker 42 provided at the upper part of the exhaust outlet 17, and thus from the speaker 42 a corrected acoustic wave substantially becomgin of anti-phase is issued.

Figure 15:
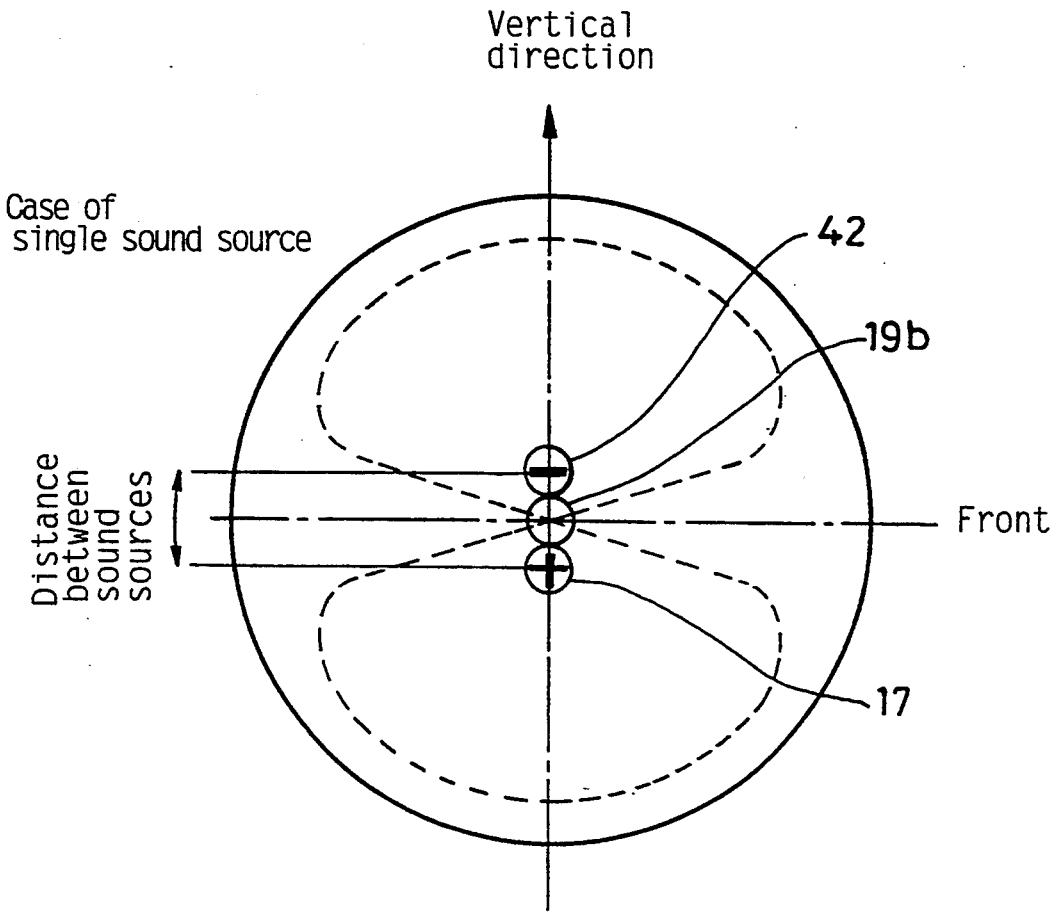
FIG. 15 is a radiation pattern of a positive-negative doublet sound source of the above-mentioned example.

Hereupon, the combustion noise is a low-frequency noise of long wavelength, and almost thereof is radiated from the exhaust outlet 17 into space. Now, the exhaust outlet 17 is taken as a positive sound source and the speaker 42 as a negative sound source-is provided at a sufficiently short distance therefrom in comparison with this wavelength, and further the sound radiation planes of the exhaust outlet 17 and the speaker 42 are arranged on one common plane, and the second microphone 19*b* is provided at a nearest position to this radiation plane and on a line connecting centers thereof; then, a positive-negative doublet sound source can be realized. That is, as is shown in FIG. 15, which is the radiation pattern of noise silencing action, the combustion noise in the front direction can be reduced largely, exhibiting a characteristic enabling the reduction of the combustion noise in all the directions, upper-, lower-, left-, and right-directions.

<SIXTH EMBODIMENT>

Figure 16:
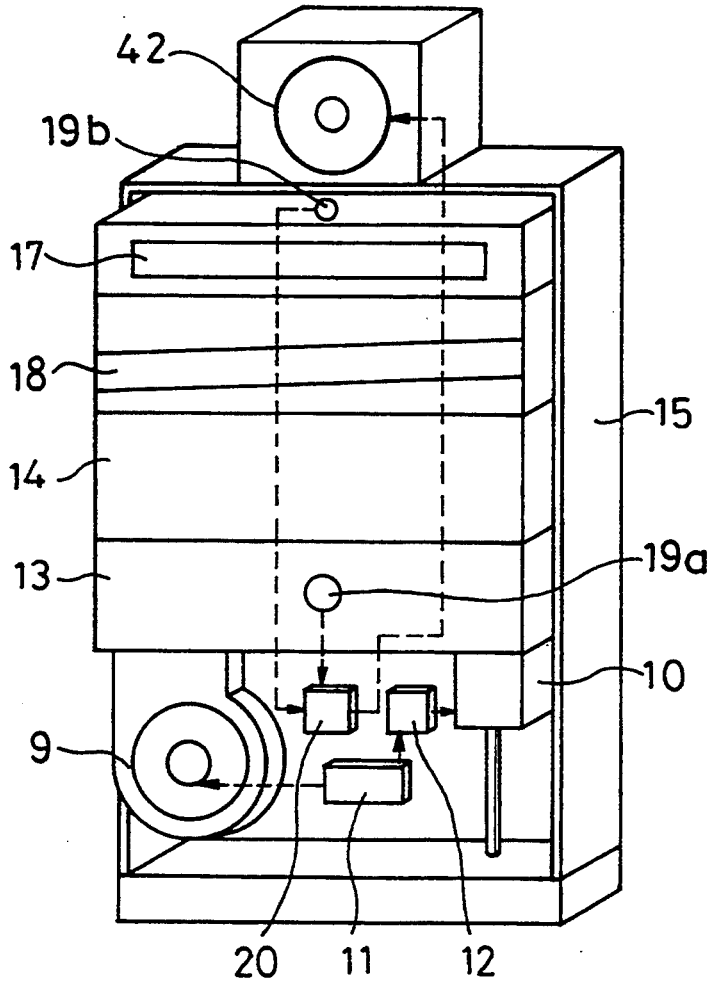
FIG. 16 is a front view of a gas hot water server as a sixth working example of the combustion apparatus of the present invention.

Next, on the sixth working example of the present invention, explanation is given referring to FIG. 16. To those parts having the same construction and performing the same function as in the fifth working example described above, the same numerals are given and detailed explanations on those parts are omitted; and the explanation is given mainly on the parts differing from the fifth working example.

As is shown in FIG. 16, the constitution of the present working example is that in which a first microphone 19*a* is provided in the burner part 13 for mixing the gas and air therein.

By using the above constitution, the pressure variation of burner part 13 is detected by the first microphone 19*a*, and the combustion noise radiated from the exhaust outlet 17 is detected by the second microphone 19*b* provided at the upper part of the exhaust outlet 17. The control action for performing the silencing of noise is carried out by the same function as in the above fifth working example. At this time, since the first microphone 19*a* is provided in the burner part 13, the first microphone 19*a* does not suffer any adverse influence due to heat, thereby the degradation-resistant characteristic or the durability against heat is improved.

<SEVENTH EMBODIMENT>

Figure 17:
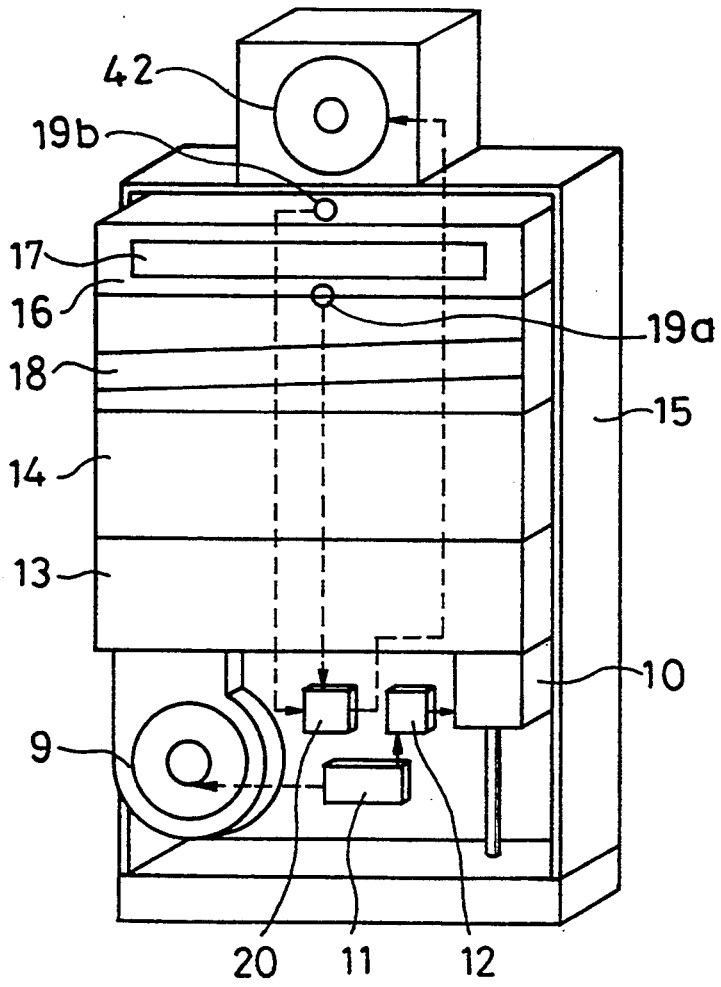
FIG. 17 is a front view of a gas hot water server as a seventh working example of the combustion apparatus of the present invention.
Figure 18:
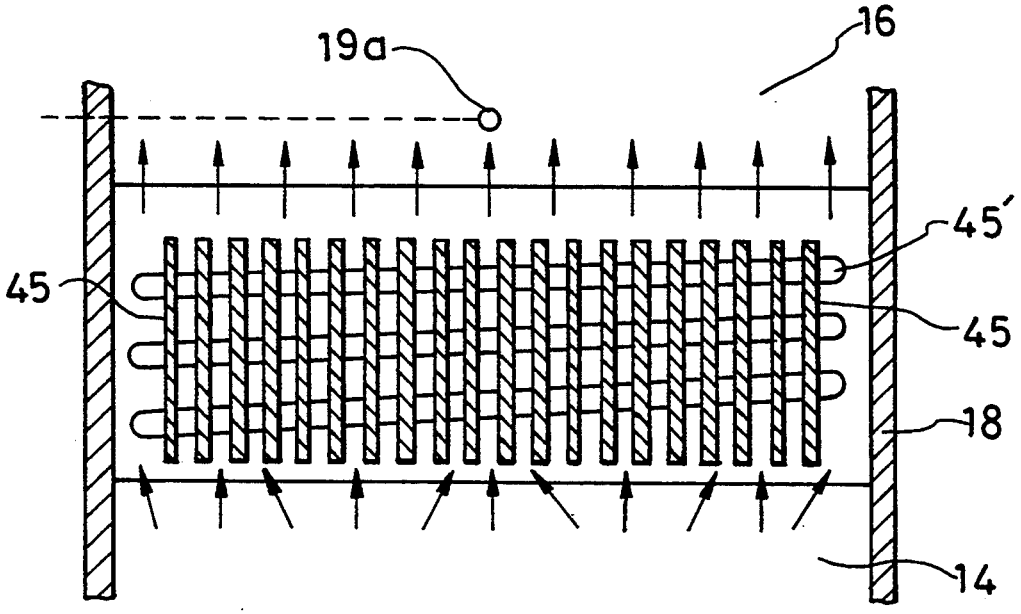
FIG. 18 is a front sectional view of a heat exchanger of the examples of the present invention.

Next, a seventh working example of the present invention is explained referring to FIG. 17 and FIG. 18. To those parts having the same construction and performing the same function as in the fifth working example described before, the same numerals are given and detailed explanations on those parts are omitted; and the explanation is given mainly on the parts differing from the fifth working example.

As is shown in FIG. 17, the constitution of the present working example is provided with an exhaust duct 16 for conducting heat and the exhaust gas produced by the combustion to an exhaust outlet 17, a heat exchanger 18 provided in the exhaust duct 16, and its first microphone 19*a* is set between the heat exchanger 18 and the exhaust outlet 17.

By using the above constitution, as is shown in FIG. 18, the first microphone 19*a* detects combustion noise of combustion-generated exhaust gas, after its turbulent flow is rectified by making it pass through spaces between a plurality of heat-collecting plates 45 of a heat exchanger 18, and the second microphone 19*b* (in FIG. 17) detects the combustion noise radiated from the exhaust outlet 17. The control action for performing the silencing of noise is to be carried out by the same function as in the fifth working example described before. At this time, since the first microphone 19*a* is provided between the heat exchanger 18 and the exhaust outlet 17, the first microphone 19*a* detects the combustion noise after the turbulent noise caused by the turbulence of the flow is suppressed by the rectification effect of a plurality of heat-collecting plates 45. Accordingly, the combustion noise in which the turbulent noise was subtracted from the combustion sound can be detected, and this makes a high-fidelity realization of the corrected anti-phase sound possible; and thereby an improvement of the suppression effect on the combustion noise by the phase interference becomes possible.

<EIGHTH EMBODIMENT>

Figure 19:
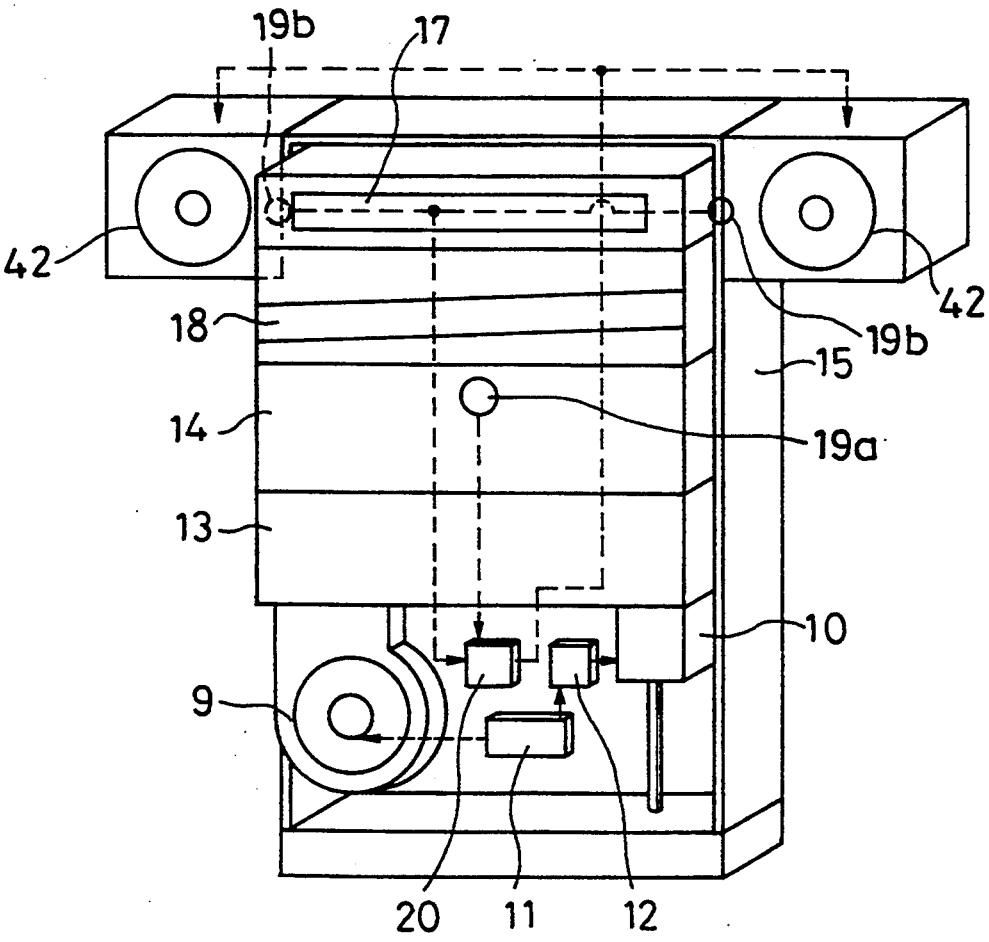
FIG. 19 is a front view of a gas hot water server as a eighth working example of the combustion apparatus of the present invention.
Figure 20:
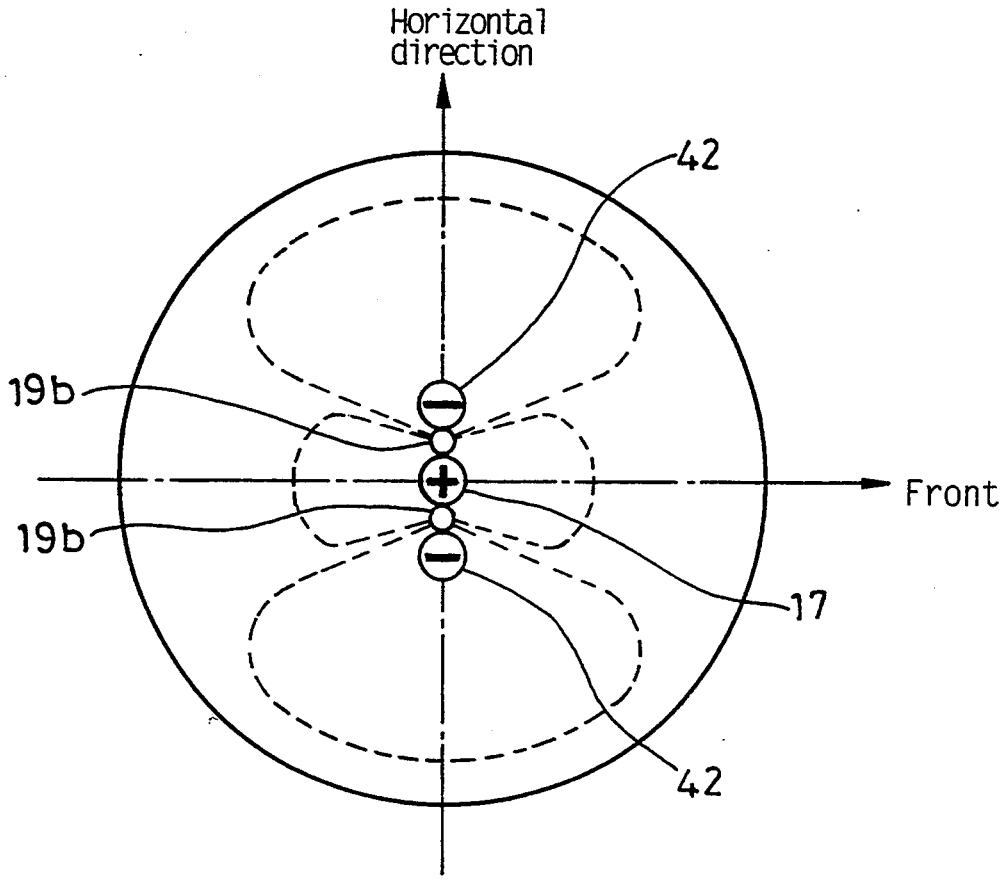
FIG. 20 is a radiation pattern of a negative-positive-negative triplet sound source of the above-mentioned example.
Figure 21:
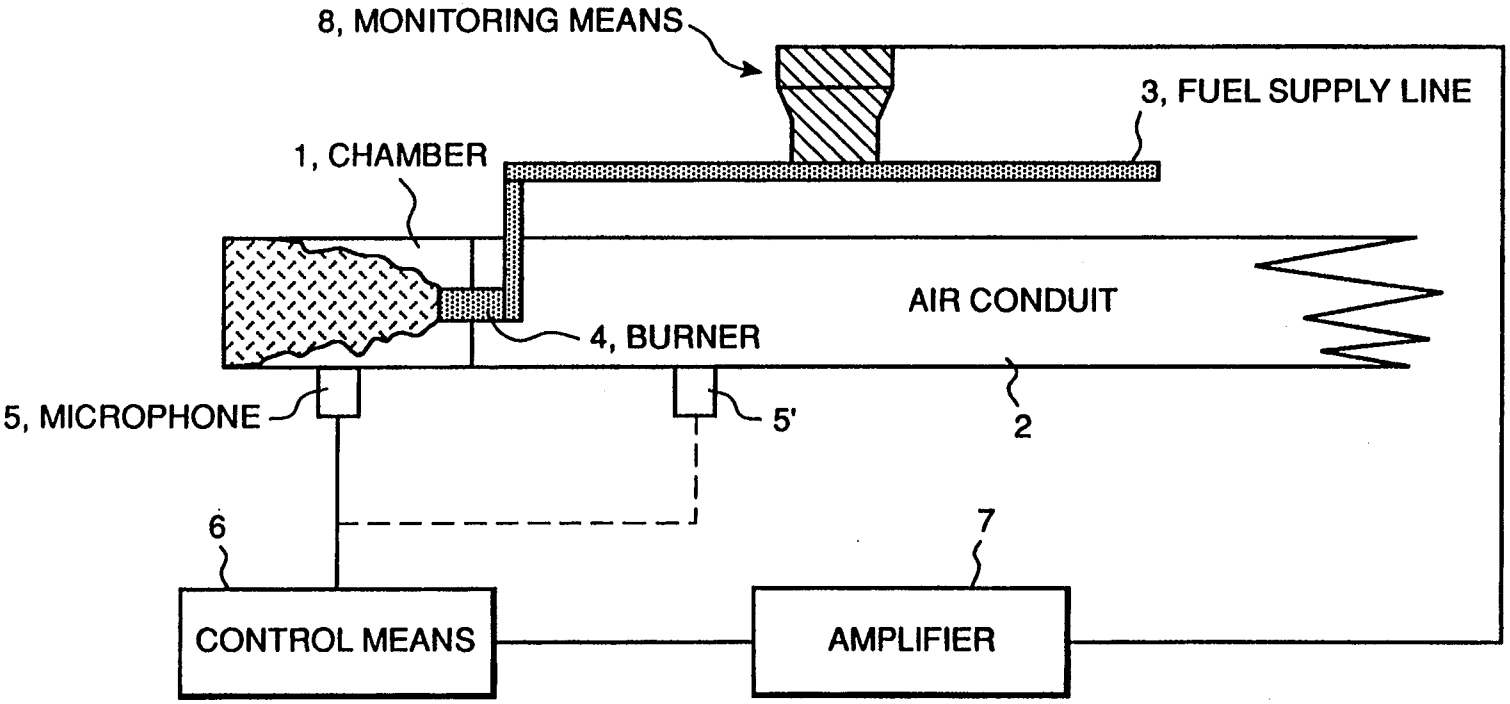
FIG. 21 (Prior Art)
Figure 22A:
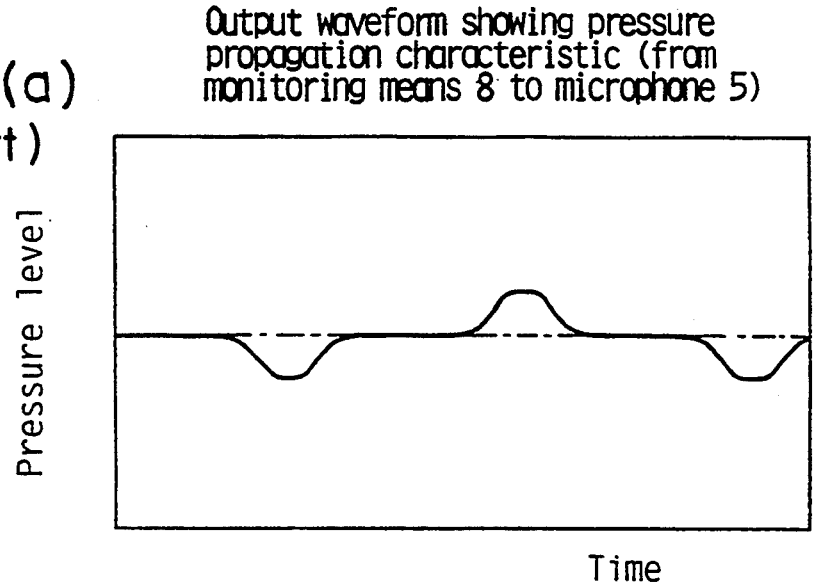
FIG. 22(a) (Prior Art)
FIG. 22(*a*), FIG. 22(*b*) and FIG. 22(*c*) are waveforms of pressure levels and noise silencing of the above-mentioned first prior art apparatus.
Figure 22B:
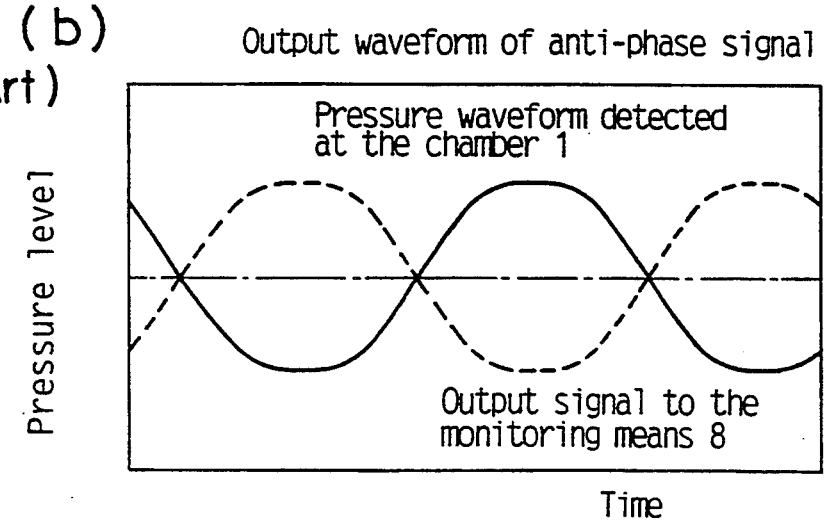
FIG. 22(b) (Prior Art)
Figure 22C:
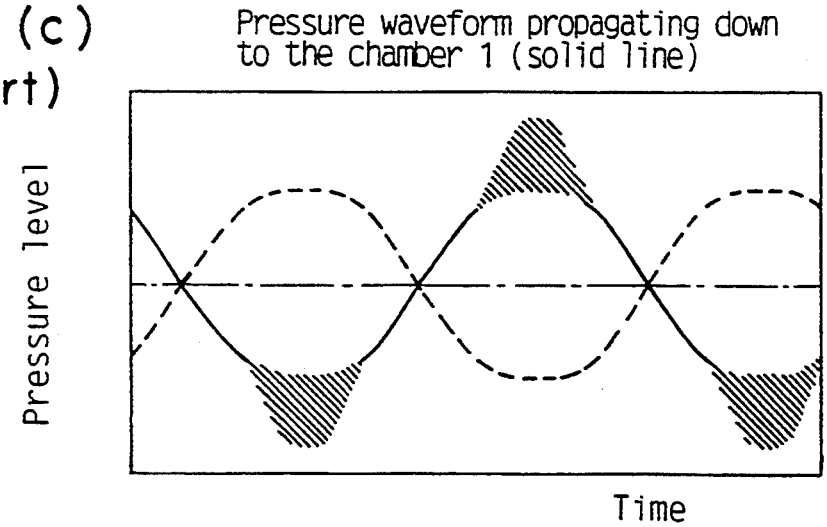
FIG. 22(c) (Prior Art)
Figure 23:
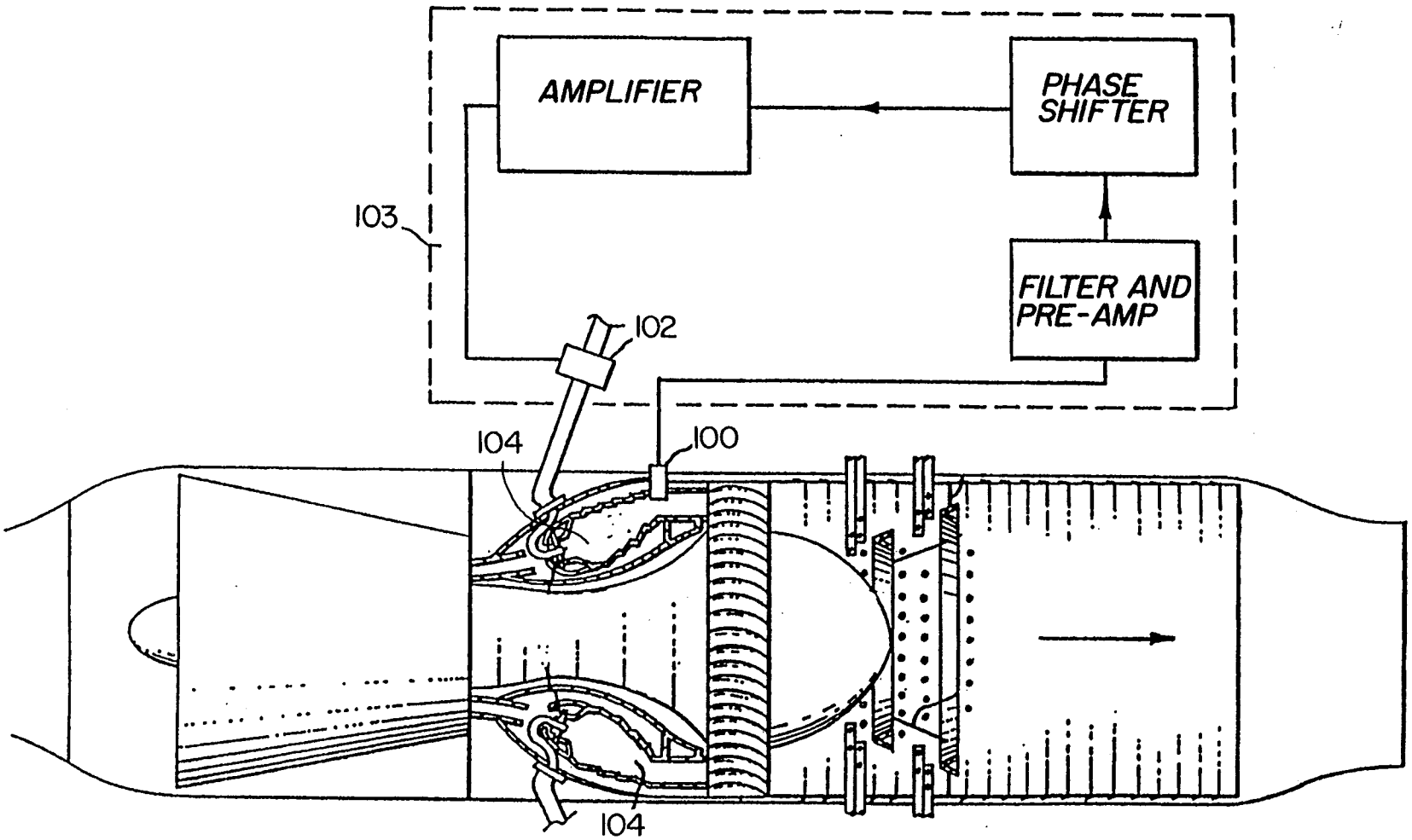
FIG. 23 (Prior Art)
Figure 24:
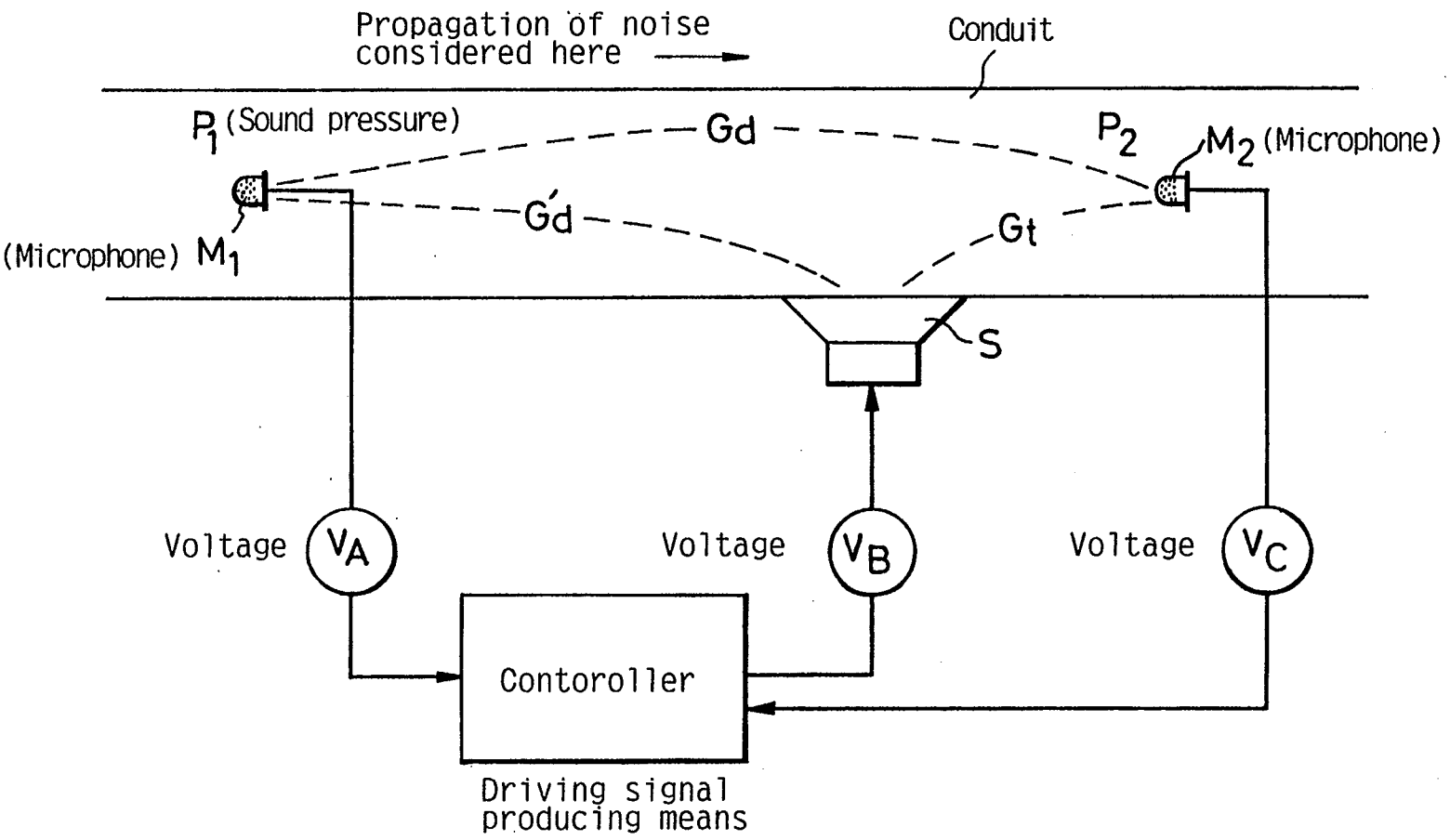
FIG. 24 (Prior Art)
Figure 25:
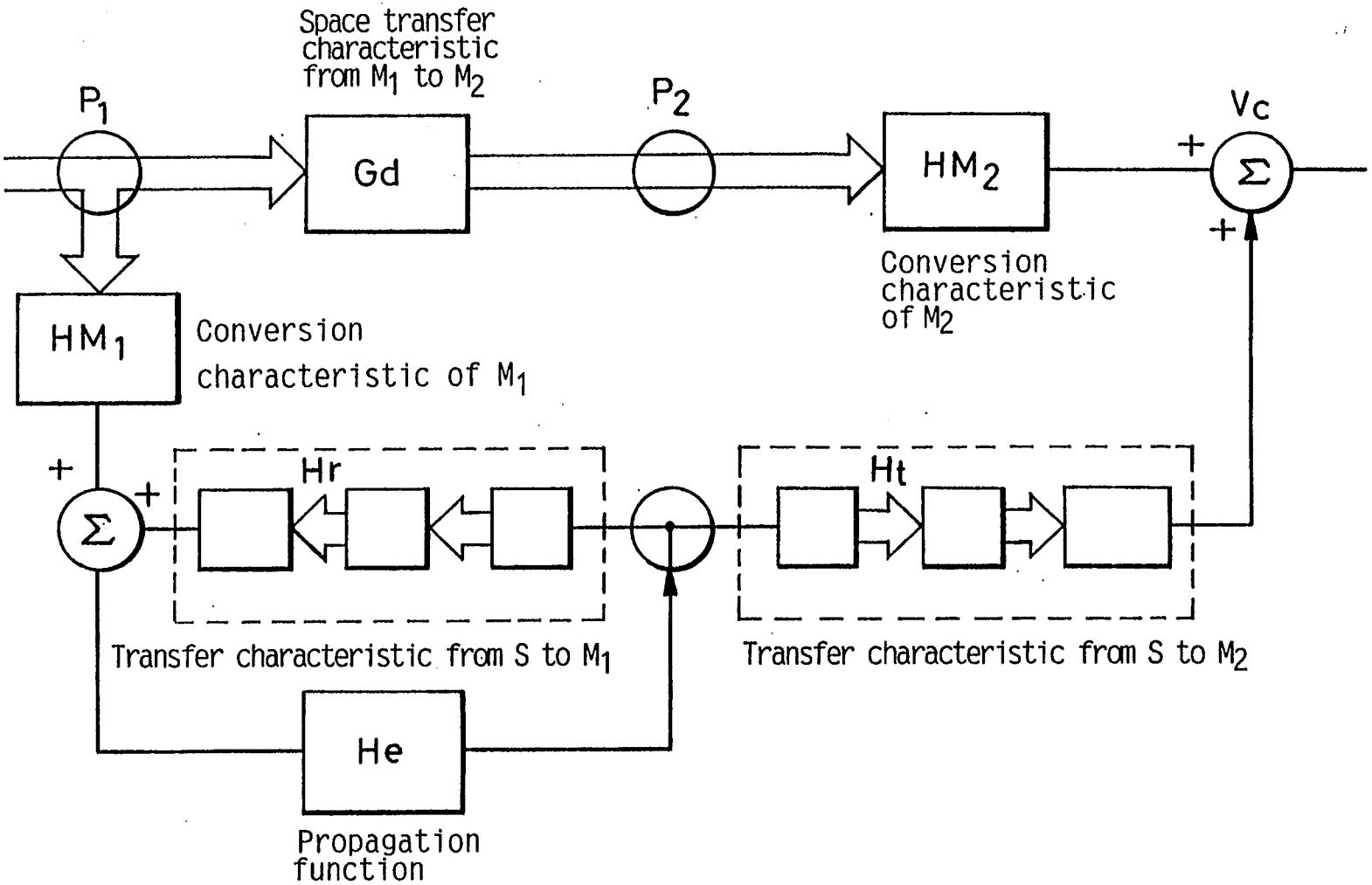
FIG. 25 (Prior Art)
FIG. 25 is a block diagram showing a model of the above-mentioned third prior art.

Next, an eighth working example of the present invention is explained referring to FIG. 19 and FIG. 20. To those parts having the same construction and performing the same function as in the fifth working example described before, the same numerals are given, and detailed explanations on those parts are omitted. And the explanation is given mainly on the parts differing from the first working example.

As is shown in FIG. 19, two speakers 42 are provided for making the noise silencing at two positions of both of left and right sides, and corrected anti-phase signal is divided and outputted. And, between respective speakers 42 and the exhaust outlet 17, two of the second microphone 19*b* are provided respectively. Then, two signals obtained from these respective microphones are added and taken into the signal processing means 20.

By using the above constitution, the combustion noise radiated into space from the exhaust outlet 17 is detected by two second microphones 19*b*. Since a corrected anti-phase sounds from those two speakers 42 are radiated in a manner that the detected combustion noise becomes minimum, the sound source constitution becomes a negative-positive-negative triplet. Thereby, the combustion noise of a radiation pattern shown in FIG. 20 can be exhibited.

Moreover, apart from the present working example wherein two speakers 42 were placed at two positions on left- and right-hand sides, a modified constitution may be configured such as placing them on upper and lower sides, which also can exhibits the similar effect.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is

1. A combustion apparatus comprising:

a fuel control means for controlling an amount of fuel supply;

a pressure detector for detecting pressure variations substantially caused by combustion of said fuel; and a feedback type control system wherein an anti-phase signal is produced based on a signal received from said pressure detector and wherein said anti-phase signal is applied to said fuel control means to cancel said pressure variations by phase interference, said feedback control system comprising:

pressure propagation characteristic correction means for correcting an influence of a pressure propagation characteristic for a path from said fuel control means to said pressure detector during combustion;

adaptive processing means for computing, based on an adaptive control rule, an anti-phase signal used to obtain substantially anti-phase pressure variations at said pressure detector in accordance with both said signal output by said pressure detector and said signal output by said pressure detector which has passed through said pressure propagation characteristic correction means; and means for applying said anti-phase signal of said adaptive processing means to said fuel control means.

2. A combustion apparatus in accordance with claim 1, further comprising:

a combustion chamber where said combustion tubes place;

an exhaust outlet from said combustion chamber, wherein said pressure detector detects pressure variations caused by combustion in said combustion chamber;

a second pressure detector for detecting pressure variations at an exhaust outlet wherein said pressure propagation characteristic correction means corrects an influence of a pressure propagation characteristic occurring in a range from said fuel control means to said second pressure detector; and means for performing computations based on both a signal output by said first pressure detector and a signal output by said second pressure detector passed through said pressure propagation characteristic correction means, and for applying a signal based on said computations to obtain pressure variations that are substantially anti-phase with respect to said signal of said second pressure detector.

3. A combustion apparatus in accordance with claim 1, further comprising:

a pressure intake tap provided at said combustion chamber;

a tube attached to said tap; and an acoustic damper provided in said tube, said tube connecting said pressure detector to said combustion chamber with said intake tap.

4. A combustion apparatus comprising:

a pressure detector for detecting pressure variations caused by combustion in said combustion apparatus;

a mixing part in which air and fuel are mixed;

a combustion part in which combustion of said air and fuel from said mixing part takes place;

acoustic wave generation means for generating an anti-phase sound to that occurring in said combustion part, said acoustic wave generation means being located upstream of said combustion part;

pressure propagation characteristic correction means for correcting an influence of a pressure propagation characteristic for a path from said acoustic wave generation means to said pressure detector during combustion; and computation means for computing, based on both a signal from said pressure detector and a signal from said pressure detector having passed through said pressure propagation characteristic correction means and for outputting to said acoustic wave generation means a signal that causes said acoustic wave generation means to generate a substantially anti-phase acoustic wave, thereby applying said acoustic wave to said burner part.

5. A combustion apparatus comprising:

a combustion chamber;

an exhaust outlet from said combustion chamber;

a first pressure detector for detecting pressure variation caused by combustion in said combustion chamber;

acoustic wave generation means provided at an upper side of said exhaust outlet for generating an anti-phase sound;

a second pressure detector provided between and in proximity to said exhaust outlet and said acoustic wave generation means; and a feed forward type control system wherein an anti-phase signal is produced based on a signal from said first and second pressure detectors and issued to said acoustic wave generation means to generate said anti-phase sound, said feed forward type control system comprising:

pressure propagation characteristic correction means for correcting an influence of a pressure propagation characteristic for a path from said acoustic wave generation means to said second pressure detector;

adaptive processing means for computing; based on an adaptive control rule; said anti-phase signal which is used to cancel combustion noises by phase interference in accordance with said signal of said first pressure detector and said signal of said second pressure detector having passed through said pressure propagation characteristic correction means, thereby minimizing signals detected by said second pressure detector; and means for radiating an output signal of said adaptive processing means as an acoustic wave from said acoustic wave generation means.

6. A combustion apparatus in accordance with claim 5, further comprising:

a mixing part in which fuel and air are mixed;

an exhaust said duct for leading exhaust gas of combustion to said exhaust outlet, and wherein said (a) first pressure detector for detecting the pressure variation caused by the combustion is located at one of said mixing part or said exhaust duct.

7. A combustion apparatus in accordance with claim 5, further comprising:

a plurality of acoustic wave generation means provided at an edge of said exhaust outlet; and a plurality of second pressure detectors provided between said exhaust outlet and said acoustic wave generation means.

* * * * *